US010825396B2

(12) United States Patent
Chen et al.

(10) Patent No.: US 10,825,396 B2
(45) Date of Patent: Nov. 3, 2020

(54) PIXEL DRIVING CIRCUIT AND METHOD FOR CONTROLLING THE SAME, DISPLAY DRIVING CIRCUIT AND METHOD FOR CONTROLLING THE SAME, AND DISPLAY PANEL

(71) Applicants: Chongqing BOE Optoelectronics Technology Co., Ltd., Chongqing (CN); BOE Technology Group Co., Ltd., Beijing (CN)

(72) Inventors: Shuai Chen, Beijing (CN); Zhi Zhang, Beijing (CN); Xiuzhu Tang, Beijing (CN); Xing Dong, Beijing (CN); Zhenguo Tian, Beijing (CN); Xuebo Liang, Beijing (CN); Ying Huang, Beijing (CN); Jianfeng Yuan, Beijing (CN)

(73) Assignees: CHONGQING BOE OPTOELECTRONICS TECHNOLOGY CO., LTD., Chongqing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/491,897

(22) PCT Filed: Feb. 1, 2019

(86) PCT No.: PCT/CN2019/074443
§ 371 (c)(1),
(2) Date: Sep. 6, 2019

(87) PCT Pub. No.: WO2019/227966
PCT Pub. Date: Dec. 5, 2019

(65) Prior Publication Data

US 2020/0074929 A1 Mar. 5, 2020

(30) Foreign Application Priority Data

May 29, 2018 (CN) ..... 2018 1 0531246

(51) Int. Cl.
*G09G 3/3258* (2016.01)

(52) U.S. Cl.
CPC ... *G09G 3/3258* (2013.01); *G09G 2300/0809* (2013.01)

(58) Field of Classification Search
CPC ..... G09G 3/3258; G09G 2300/0809; G09G 2230/00; G09G 2310/0243;
(Continued)

(56) References Cited

U.S. PATENT DOCUMENTS

| | | | |
|---|---|---|---|
| 7,193,588 | B2 | 3/2007 | Lo |
| 9,640,109 | B2 | 5/2017 | Yang |
| 10,140,903 | B2 | 11/2018 | Lee et al. |
| 10,504,438 | B2 | 12/2019 | Bao et al. |

(Continued)

FOREIGN PATENT DOCUMENTS

| | | | |
|---|---|---|---|
| CN | 104252845 | A | 12/2014 |
| CN | 104361862 | A | 2/2015 |

(Continued)

*Primary Examiner* — Rodney Amadiz
(74) *Attorney, Agent, or Firm* — Westman, Champlin & Koehler, P.A.

(57) ABSTRACT

The present disclosure provides a pixel driving circuit and method thereof, a display driving circuit and method thereof, and a display panel. The pixel driving circuit includes: a first pixel driving sub-circuit configured to provide a driving signal to a driving signal output terminal in a first period and perform threshold voltage compensation on a second pixel driving sub-circuit in a second period under control of signals at a first scanning signal terminal, a first control signal terminal, and a first data signal terminal; and the second pixel driving sub-circuit configured to provide a driving signal to the driving signal output terminal in the second period and perform threshold voltage compensation (Continued)

on the first pixel driving sub-circuit in the first period under control of signals at a second scanning signal terminal, a second control signal terminal, and a second data signal terminal.

20 Claims, 20 Drawing Sheets

(58) Field of Classification Search
CPC ..... G09G 2310/067; G09G 2310/0262; G09G 3/3233; G09G 2300/0814; G09G 2300/0819; G09G 2300/0823; G09G 2300/0852; G09G 2300/0861; G09G 3/3225
See application file for complete search history.

(56) References Cited

U.S. PATENT DOCUMENTS

| | | | | |
|---|---|---|---|---|
| 10,665,154 | B1 * | 5/2020 | Chen | G09G 3/3233 |
| 2005/0068271 | A1 | 3/2005 | Lo | |
| 2016/0189604 | A1 * | 6/2016 | Hu | G09G 3/3225 345/215 |
| 2016/0253963 | A1 | 9/2016 | Yang | |
| 2016/0335937 | A1 | 11/2016 | Lee et al. | |
| 2017/0110056 | A1 * | 4/2017 | Hu | G09G 3/3258 |
| 2017/0263184 | A1 * | 9/2017 | Chen | G09G 3/3233 |
| 2018/0025690 | A1 | 1/2018 | Bao et al. | |

FOREIGN PATENT DOCUMENTS

| | | | |
|---|---|---|---|
| CN | 105609047 | A | 5/2016 |
| CN | 108717841 | A | 10/2018 |

* cited by examiner

PIXEL DRIVING CIRCUIT AND METHOD FOR CONTROLLING THE SAME, DISPLAY DRIVING CIRCUIT AND METHOD FOR CONTROLLING THE SAME, AND DISPLAY PANEL

CROSS-REFERENCE TO RELATED APPLICATION(S)

This application is a Section 371 National Stage Application of International Application No. PCT/CN2019/074443, filed on Feb. 1, 2019, and claims priority to Chinese Patent Application No. 201810531246.X, filed on May 29, 2018, which are incorporated herein by reference in their entirety.

TECHNICAL FIELD

The present disclosure relates to the field of display, and more particularly, to a pixel driving circuit and a method for controlling the same, a display driving circuit and a method for controlling the same, and a display panel.

BACKGROUND

In a conventional display panel, for example, an Organic Light Emitting Diode (OLED) display panel, threshold voltages of transistors for driving a light emitting element in a display driving circuit are unevenly distributed on the display panel or the threshold voltages of the transistors may drift due to being in an operation state for a long time, which may influence the display effect.

SUMMARY

According to an aspect of the present disclosure, there is provided a pixel driving circuit, the pixel driving circuit comprising: a first pixel driving sub-circuit and a second pixel driving sub-circuit, wherein the first pixel driving sub-circuit is connected to a first scanning signal terminal, a first control signal terminal, a first data signal terminal and a driving signal output terminal, and the first pixel driving sub-circuit is configured to provide a driving signal to the driving signal output terminal in a first period and perform threshold voltage compensation on the second pixel driving sub-circuit in a second period under control of signals at the first scanning signal terminal, the first control signal terminal, and the first data signal terminal; and the second pixel driving sub-circuit is connected to a second scanning signal terminal, a second control signal terminal, a second data signal terminal and the driving signal output terminal, and the second pixel driving sub-circuit is configured to provide a driving signal to the driving signal output terminal in the second period and perform threshold voltage compensation on the first pixel driving sub-circuit in the first period under control of signals at the second scanning signal terminal, the second control signal terminal, and the second data signal terminal.

In an example, the first pixel driving sub-circuit comprises:

a first control sub-circuit connected to a first control signal terminal, a first power signal terminal, and a first control node, the first control sub-circuit is configured to output a signal at the first power signal terminal to the first control node under control of a signal at the first control signal terminal; and a first driving sub-circuit connected to the first control node, the first data signal terminal, the first scanning signal terminal, and the driving signal output terminal, the first driving sub-circuit is configured to provide the driving signal to the driving signal output terminal in the first period and perform threshold voltage compensation on the second pixel driving sub-circuit in the second period under control of signals at the first data signal terminal, the first scanning signal terminal, and the first control node.

In an example, the first driving sub-circuit comprises a first transistor, a second transistor and a first capacitor, wherein the first transistor has a gate connected to the first scanning signal terminal, a first electrode connected to the first data signal terminal, and a second electrode connected to a gate of the second transistor, the second transistor has a first electrode connected to the first control node, and a second electrode connected to the driving signal output terminal, and the first capacitor has one terminal connected to the gate of the second transistor, and the other terminal connected to the driving signal output terminal; and the first control sub-circuit comprises a third transistor, wherein the third transistor has a gate connected to the first control signal terminal, a first electrode connected to the first power signal terminal, and a second electrode connected to the first control node.

In an example, the second pixel driving sub-circuit comprises:

a second control sub-circuit connected to a second control signal terminal, a second power signal terminal, and a second control node, the second control sub-circuit is configured to output a signal at the second power signal terminal to the second control node under control of a signal at the second control signal terminal; and a second driving sub-circuit connected to the second control node, the second data signal terminal, the second scanning signal terminal, and the driving signal output terminal, the second driving sub-circuit is configured to provide the driving signal to the driving signal output terminal in the second period and perform threshold voltage compensation on the first pixel driving sub-circuit in the first period under control of signals at the second data signal terminal, the second scanning signal terminal, and the second control node.

In an example, the second driving sub-circuit comprises a fourth transistor, a fifth transistor and a second capacitor, wherein the fourth transistor has a gate connected to the second scanning signal terminal, a first electrode connected to the second data signal terminal, and a second electrode connected to a gate of the fifth transistor, the fifth transistor has a first electrode connected to the second control node, and a second electrode connected to the driving signal output terminal, and the second capacitor has one terminal connected to the gate of the fifth transistor, and the other terminal connected to the driving signal output terminal; and the second control sub-circuit comprises a sixth transistor, wherein the sixth transistor has a gate connected to the second control signal terminal, a first electrode connected to the second power signal terminal, and a second electrode connected to the second control node.

According to another aspect of the present disclosure, there is provided a display driving circuit, comprising a plurality of pixel driving circuits described above, which are arranged in an N×M array, where N and M are positive integers.

In an example, a second control sub-circuit of a pixel driving circuit in an $n^{th}$ row and an $m^{th}$ column is multiplexed as a first control sub-circuit of a pixel driving circuit in an $(n+1)^{th}$ row and the $m^{th}$ column, a second control signal terminal of the pixel driving circuit in the $n^{th}$ row and the $m^{th}$ column is multiplexed as a first control signal terminal of the pixel driving circuit in the $(n+1)^{th}$ row and the $m^{th}$ column, a second power signal terminal of the pixel driving circuit in the $n^{th}$ row and the $m^{th}$ column is multiplexed as a first power signal terminal of the pixel driving circuit in the $(n+1)^{th}$ row and the $m^{th}$ column, and a second control node of the pixel driving circuit in the $n^{th}$ row and the $m^{th}$ column is multiplexed as a first control node of the pixel driving circuit in the $(n+1)^{th}$ row and the $m^{th}$ column, where n is a positive integer greater than or equal to 1 and less than or equal to N−1, and m is a positive integer greater than or equal to 1 and less than or equal to M.

According to another aspect of the present disclosure, there is provided a display panel, comprising the display driving circuit described above.

According to another aspect of the present disclosure, there is provided a method for controlling the pixel driving circuit described above, comprising:

controlling, in a first period, the first pixel driving sub-circuit to generate a driving signal, and controlling the second pixel driving sub-circuit to perform threshold voltage compensation on the first pixel driving sub-circuit; and controlling, in a second period, the second pixel driving sub-circuit to generate a driving signal, and controlling the first pixel driving sub-circuit to perform threshold voltage compensation on the second pixel driving sub-circuit.

In an example, the first driving sub-circuit in the first pixel driving sub-circuit comprises a first transistor, a second transistor, and a first capacitor, and controlling, in a first period, the first pixel driving sub-circuit to generate a driving signal, and controlling the second pixel driving sub-circuit to perform threshold voltage compensation on the first pixel driving sub-circuit comprises:

applying, in an inversion recovery phase, a first level to the first scanning signal terminal, applying the first level to the second control signal terminal, and applying a reference level to the second power signal terminal, so that a level at the driving signal output terminal is inverted by the second pixel driving sub-circuit;

applying, in a threshold voltage latching phase, the first level to the first control signal terminal, applying a second level to the second control signal terminal, and applying a power level to the second power signal terminal, so that a threshold voltage of a second transistor is latched in a first capacitor;

causing, in a data voltage input phase, applying the second level to the first control signal terminal, and applying a first data signal to the first data signal terminal, so that the first data signal at the first data signal terminal is input into a gate of the second transistor; and causing, in a light emitting phase, the first scanning signal terminal to change from the first level to the second level, and causing the first control signal terminal to change from the second level to the first level, so that a driving signal is provided to the driving signal output terminal.

In an example, controlling, in a first period, the first pixel driving sub-circuit to generate a driving signal, and controlling the second pixel driving sub-circuit to perform threshold voltage compensation on the first pixel driving sub-circuit further comprises:

applying, in a voltage adjustment phase between the inversion recovery phase and the threshold voltage latching phase, the first level to the second scanning signal terminal, causing the second control signal terminal to change from the first level to the second level, and causing the second power signal terminal to change from the reference level to the power level.

In an example, in the light emitting phase, the first scanning signal terminal is caused to change from the first level to the second level before causing the first control signal terminal to change from the second level to the first level.

In an example, a second driving sub-circuit in the second pixel driving sub-circuit comprises a fourth transistor, a fifth transistor and a second capacitor, and controlling, in a second period, the second pixel driving sub-circuit to generate a driving signal, and controlling the first pixel driving sub-circuit to perform threshold voltage compensation on the second pixel driving sub-circuit comprises:

applying, in an inversion recovery phase, a first level to the second scanning signal terminal, applying the first level to the first control signal terminal, and applying a reference level to the first power signal terminal, so that a level at the driving signal output terminal is inverted by the first pixel driving sub-circuit;

applying, in a threshold voltage latching phase, the first level to the second control signal terminal, applying a second level to the first control signal terminal, and applying a power level to the first power signal terminal, so that a threshold voltage of a fifth transistor is latched in a second capacitor;

applying, in a data voltage input phase, the second level to the second control signal terminal, and applying a second data signal to the second data signal terminal, so that the second data signal at the second data signal terminal is input into a gate of the fifth transistor; and causing, in a light emitting phase, the second scanning signal terminal to change from the first level to the second level, and causing the second control signal terminal to change from the second level to the first level, so that a driving signal is provided to the driving signal output terminal.

In an example, in the light emitting phase, the second scanning signal terminal is caused to change from the first level to the second level before causing the second control signal terminal to change from the second level to the first level.

In an example, the first period is an odd frame, and the second period is an even frame; or the first period is an even frame, and the second period is an odd frame.

According to another aspect of the present disclosure, there is provided a method for controlling the display driving circuit described above, comprising: for each of the plurality of pixel driving circuits in the display driving circuit, controlling, in a first period, a first pixel driving sub-circuit to generate a driving signal, and controlling a second pixel driving sub-circuit to perform threshold voltage compensation on the first pixel driving sub-circuit; and controlling, in a second period, the second pixel driving sub-circuit to generate a driving signal, and controlling the first pixel driving sub-circuit to perform threshold voltage compensation on the second pixel driving sub-circuit.

In an example, a first driving sub-circuit in the first pixel driving sub-circuit comprises a first transistor, a second transistor and a first capacitor, and for a pixel driving circuit in an $n^{th}$ row and an $m^{th}$ column, controlling, in a first period, a first pixel driving sub-circuit to generate a driving signal, and controlling a second pixel driving sub-circuit to perform threshold voltage compensation on the first pixel driving sub-circuit comprises:

applying, in an inversion recovery phase, a first level to a first scanning signal terminal of the pixel driving circuit in the $n^{th}$ row and the $m^{th}$ column, applying the first level to a second control signal terminal of the pixel driving circuit in the $n^{th}$ row and the $m^{th}$ column, and applying a reference level to a second power signal terminal of the pixel driving circuit in the $n^{th}$ row and the $m^{th}$ column, so that a level at a driving signal output terminal of the pixel driving circuit in the $n^{th}$ row and the $m^{th}$ column is inverted;

applying, in a threshold voltage latching phase, the first level to a first control signal terminal of the pixel driving circuit in the $n^{th}$ row and the $m^{th}$ column, applying a second level to the second control signal terminal of the pixel driving circuit in the $n^{th}$ row and the $m^{th}$ column, and applying a power level to a second power signal terminal of the pixel driving circuit in the $n^{th}$ row and the $m^{th}$ column, so that a threshold voltage of a second transistor is latched in a first capacitor in the pixel driving circuit in the $n^{th}$ row and the $m^{th}$ column;

applying, in a data voltage input phase, the second level to the first control signal terminal of the pixel driving circuit in the $n^{th}$ row and the $m^{th}$ column, and applying a first data signal to a first data signal terminal of the pixel driving circuit in the $n^{th}$ row and the $m^{th}$ column, so that the first data signal at the first data signal terminal is input into a gate of the second transistor in the pixel driving circuit in the $n^{th}$ row and the $m^{th}$ column; and causing, in a light emitting phase, the first scanning signal terminal of the pixel driving circuit in the $n^{th}$ row and the $m^{th}$ column to change from the first level to the second level, and causing the first control signal terminal of the pixel driving circuit in the $n^{th}$ row and the $m^{th}$ column to change from the second level to the first level, so that a driving signal is provided to the driving signal output terminal of the pixel driving circuit in the $n^{th}$ row and the $m^{th}$ column.

In an example, the first pixel driving sub-circuit comprises a first control sub-circuit and a first driving sub-circuit, the second pixel driving sub-circuit comprises a second control sub-circuit and a second driving sub-circuit, wherein the second driving sub-circuit comprises a fourth transistor, a fifth transistor, and a second capacitor, and a second control sub-circuit of a pixel driving circuit in an $n^{th}$ row and an $m^{th}$ column is multiplexed as a first control sub-circuit of a pixel driving circuit in an $(n+1)^{th}$ row and the $m^{th}$ column, and for the pixel driving circuit in the $n^{th}$ row and the $m^{th}$ column, controlling, in a second period, the second pixel driving sub-circuit to generate a driving signal, and controlling the first pixel driving sub-circuit to perform threshold voltage compensation on the second pixel driving sub-circuit comprises:

applying, in an inversion recovery phase, a first level to a first scanning signal terminal of the pixel driving circuit in the $(n+1)^{th}$ row and the $m^{th}$ column, and applying the first level to a second scanning signal terminal of the pixel driving circuit in the $(n+1)^{th}$ row and the $m^{th}$ column, so that a level at a driving signal output terminal of the pixel driving circuit in the $(n+1)^{th}$ row and the $m^{th}$ column is inverted;

applying, in a threshold voltage latching phase, the first level to a second scanning signal terminal of the pixel driving circuit in the $n^{th}$ row and the $m^{th}$ column, applying the first level to a first control signal terminal of the pixel driving circuit in the $n^{th}$ row and the $m^{th}$ column, and applying the first level to a second control signal terminal of the pixel driving circuit in the $n^{th}$ row and the $m^{th}$ column, so that a threshold voltage of a fifth transistor is latched in a second capacitor in the pixel driving circuit in the $n^{th}$ row and the $m^{th}$ column;

applying, in a data voltage input phase, the second level to the second control signal terminal of the pixel driving circuit in the $n^{th}$ row and the $m^{th}$ column, and applying a second data signal to a second data signal terminal of the pixel driving circuit in the $n^{th}$ row and the $m^{th}$ column, so that the second data signal at the second data signal terminal is input into a gate of the fifth transistor in the pixel driving circuit in the $n^{th}$ row and the $m^{th}$ column; and causing, in a light emitting phase, the second scanning signal terminal of the pixel driving circuit in the $n^{th}$ row and the $m^{th}$ column to change from the first level to the second level, and causing the second control signal terminal of the pixel driving circuit in the $n^{th}$ row and the $m^{th}$ column to change from the second level to the first level, so that a driving signal is provided to the driving signal output terminal of the pixel driving circuit in the $n^{th}$ row and the $m^{th}$ column.

In an example, in the light emitting phase, the second scanning signal terminal of the pixel driving circuit in the $n^{th}$ row and the $m^{th}$ column is caused to change from the first level to the second level before causing the second control signal terminal of the pixel driving circuit in the $n^{th}$ row and the $m^{th}$ column to change from the second level to the first level.

In an example, the method further comprises: applying, in the inversion recovery phase, the first level to a first scanning signal terminal of a pixel driving circuit in an $(n+2)^{th}$ row and the $m^{th}$ column, and applying the second level to a second scanning signal terminal of the pixel driving circuit in an $(n+2)^{th}$ row and the $m^{th}$ column.

BRIEF DESCRIPTION OF THE ACCOMPANYING DRAWINGS

DETAILED DESCRIPTION

Figure 1:
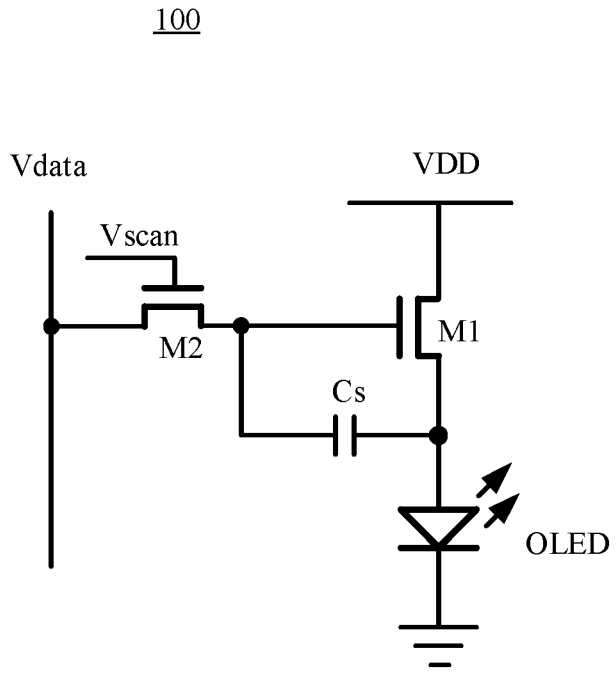
FIG. 1 illustrates a schematic circuit diagram of a pixel driving circuit.

In order to make the purposes, technical solutions and advantages of the embodiments of the present disclosure more clear, the technical solutions in the embodiments of the present disclosure will be clearly and completely described below in conjunction with the accompanying drawings in the embodiments of the present disclosure. Obviously, the embodiments described are a part of the embodiments of the present disclosure instead of all the embodiments. All other embodiments obtained by those of ordinary skill in the art based on the described embodiments of the present disclosure without contributing any creative work are within the protection scope of the present disclosure. It should be illustrated that throughout the accompanying drawings, the same elements are represented by the same or similar reference signs. In the following description, some specific embodiments are for illustrative purposes only and are not to be construed as limiting the present disclosure, but merely examples of the embodiments of the present disclosure. The conventional structure or construction will be omitted when it may cause confusion with the understanding of the present disclosure. It should be illustrated that shapes and dimensions of components in the figures do not reflect true sizes and proportions, but only illustrate contents of the embodiments of the present disclosure.

In addition, in the description of the embodiments of the present disclosure, the terms "first level" and "second level" are only used to distinguish magnitudes of the two levels from each other. For example, description is made below by taking the "first level" being a low level as an example. It may be understood by those skilled in the art that the present disclosure is not limited thereto.

Herein, a transistor mentioned in the present disclosure may be a Thin Film Transistor (TFT) or a field effect transistor or other devices having the same characteristics. The transistor may be an N-type or P-type transistor, and the two transistors may be used interchangeably by changing levels. Hereinafter, description is made by taking an N-type transistor as an example, wherein the N-type transistor is turned on when a gate thereof inputs a high level and is turned off when the gate inputs a low level. The transistor is described below as comprising a gate, a first electrode, and a second electrode, and it should be understood that the first electrode is one of a source and a drain and the second electrode is the other of the source and the drain.

Herein, for the convenience of description, it is considered that pixels on a display panel are driven progressively, that is, each row of pixels is driven simultaneously, and different rows of pixels are sequentially driven row by row. It should be understood that the embodiments of the present disclosure are not limited thereto. For convenience of description, a time taken to drive respective rows of pixels on the display panel to emit light progressively once is determined as one frame, and a time taken to drive each row of pixels to emit light is one sub-frame. It should be understood that, the embodiments of the present disclosure are not limited thereto.

The embodiments of the present disclosure will be described below with reference to the accompanying drawings.

FIG. 1 illustrates a schematic circuit diagram of a pixel driving circuit 100.

As shown in FIG. 1, the pixel driving circuit 100 has a 2T1C structure comprising a transistor M1 (a driving transistor), a transistor M2 (a charging control transistor), and a capacitor Cs (a storage capacitor). In FIG. 1, a light emitting element is an organic light emitting diode OLED, which may be driven by current to emit light. When a certain row of pixels is scanned, a scanning signal terminal Vscan of the row of pixels is at a high level, and for each pixel in the row of pixels, the transistor M2 is turned on, and a data signal at a data signal terminal Vdata is written into the capacitor Cs. When the row of pixels is scanned completely, a scanning signal at the scanning signal terminal Vscan changes to a low level signal, so that the transistor M2 is turned off. At this time, the transistor M1 generates current under action of a voltage stored on the capacitor Cs to drive the OLED, so that the OLED continuously emits light (for example, during display of one frame). A formula for source-drain current (light emitting current of the OLED) of the transistor M1 in a saturation region is $I_{ds}=K(Vgs-Vth)^2$, where K is a parameter relate to a process and design, Vgs is a gate-source voltage of the transistor M1, and Vth is a threshold voltage of the transistor M1. Once a size and a process of the transistor are determined, the parameter K is determined. It may be seen that current used to drive the OLED is related to the threshold voltage of the transistor M1. However, as described above, with the pixel driving circuit thus configured, the display effect may be affected due to an uneven distribution of threshold voltages of the transistors on the panel or a drift of the threshold voltages.

Figure 2:
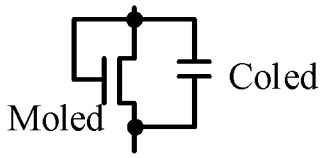
FIG. 2 illustrates an equivalent circuit diagram of a light emitting element of FIG. 1.

It should be illustrated that an equivalent circuit of the light emitting element OLED in FIG. 1 is as shown in FIG. 2, the light emitting element OLED is equivalent to one transistor Moled and one capacitor Coled, and two terminals of the capacitor Coled are connected to a source and a drain of the transistor Moled respectively.

Figure 3:
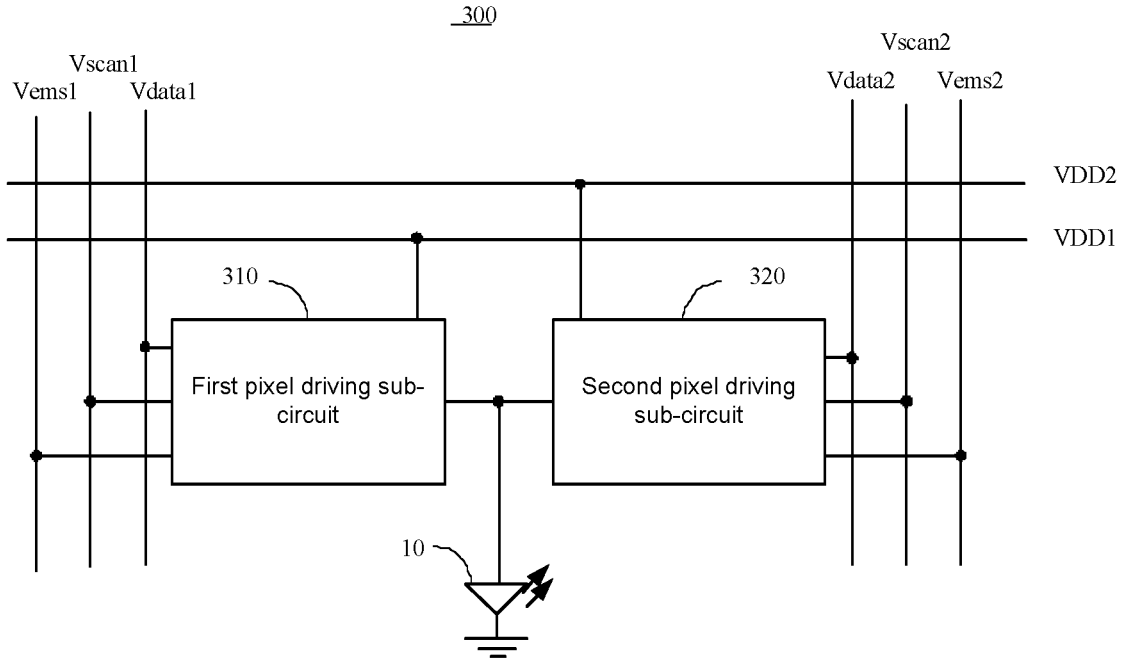
FIG. 3 illustrates a schematic block diagram of a pixel driving circuit according to an embodiment of the present disclosure.

FIG. 3 illustrates a schematic block diagram of a pixel driving circuit 300 according to an embodiment of the present disclosure.

As shown in FIG. 3, the pixel driving circuit 300 comprises a first pixel driving sub-circuit 310 and a second pixel driving sub-circuit 320.

The first pixel driving sub-circuit 310 may generate a driving signal or perform threshold voltage compensation on the second pixel driving sub-circuit 320, and the second pixel driving sub-circuit 320 may generate a driving signal or perform threshold voltage compensation on the first pixel driving sub-circuit 310. The driving signals generated by the first pixel driving sub-circuit 310 and the second pixel driving sub-circuit 320 may be provided to a light emitting element 10. Examples of the light emitting element 10 comprise, but not limited to, an OLED.

For example, the first pixel driving sub-circuit 310 may be connected to a first data signal terminal Vdata1 to receive a first data signal, may be connected to a first power signal terminal VDD1 to receive a first power signal, may be connected to a first scanning signal terminal Vscan1 to receive a first scanning signal, may be connected to a first control signal terminal Vems1 to receive a first control signal, and may generate a driving signal in a first period and perform threshold voltage compensation on the second pixel driving sub-circuit 320 in a second period under control of the first data signal, the first power signal, the first scanning signal, and the first control signal. The driving signal generated by the first pixel driving sub-circuit 310 is provided to an input terminal of the light emitting element 10.

The second pixel driving sub-circuit 320 may be connected to a second data signal terminal Vdata2 to receive a second data signal, may be connected to a second power signal terminal VDD2 to receive a second power signal, may be connected to a second scanning signal terminal Vscan2 to receive a second scanning signal, may be connected to a second control signal terminal Vems2 to receive a second control signal, and may generate a driving signal in a second period and perform threshold voltage compensation on the first pixel driving sub-circuit 310 in a first period under control of the second data signal, the second power signal, the second scanning signal, and the second control signal. The driving signal generated by the second pixel driving sub-circuit 320 is provided to the input terminal of the light emitting element 10.

The first pixel driving sub-circuit 310 and the second pixel driving sub-circuit 320 may drive the light emitting element 10 in a time division manner. For example, the driving signal is generated by the first pixel driving sub-circuit 310 to drive the light emitting element 10 in the first period (for example, an odd frame), and the driving signal is generated by the second pixel driving sub-circuit 320 to drive the light emitting element 10 in the second period (for example, an even frame). During one of the first pixel driving sub-circuit 310 and the second pixel driving sub-circuit 320 generates a driving signal, the other pixel driving sub-circuit may perform threshold voltage compensation on the pixel driving sub-circuit (for example, a driving transistor therein) which generates the driving signal, so as to eliminate the influence of the threshold voltage on the generated driving current. For example, in the first period, the first pixel driving sub-circuit 310 generates the driving signal, and the second pixel driving sub-circuit 320 performs threshold voltage compensation on the first pixel driving sub-circuit 310; and in the second period, the second pixel driving sub-circuit 320 generates the driving signal, and the first pixel driving sub-circuit 310 performs threshold voltage compensation on the second pixel driving sub-circuit 320.

Figure 4:
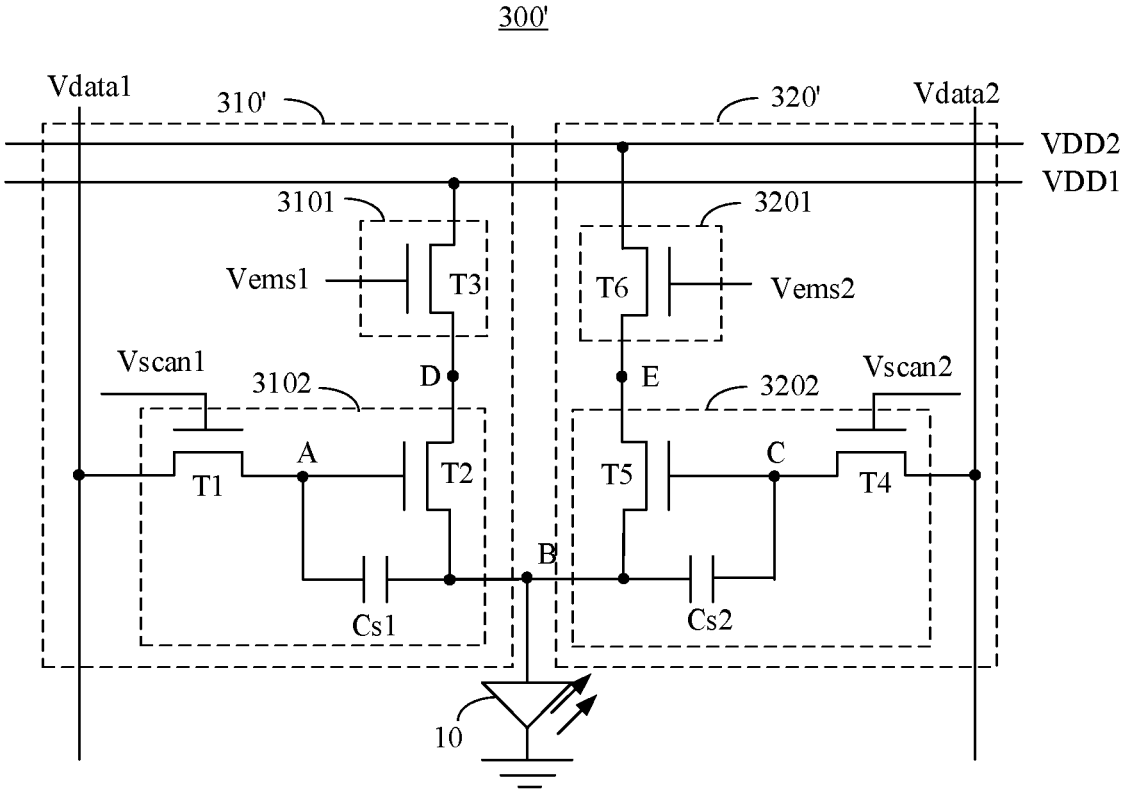
FIG. 4 illustrates an exemplary circuit diagram of a pixel driving circuit according to an embodiment of the present disclosure.

FIG. 4 illustrates an exemplary circuit diagram of a pixel driving circuit 300' according to an embodiment of the present disclosure.

As shown in FIG. 4, the pixel driving circuit 300' comprises a first pixel driving sub-circuit 310' and a second pixel driving sub-circuit 320'. A driving signal generated by each of the first pixel driving sub-circuit 310' and the second pixel driving sub-circuit 320' is provided to a light emitting element 10 at a driving signal output terminal B.

The first pixel driving sub-circuit 310' comprises a first control sub-circuit 3101 and a first driving sub-circuit 3102. The first control sub-circuit 3101 is connected to a first control signal terminal Vems1 for providing a first control signal, a first power signal terminal VDD1 for providing a first power signal, and a first control node D. The first control sub-circuit 3101 may output a first power signal at the first control node D under control of the first control signal. The first driving sub-circuit 3102 is connected to the first control node D and the driving signal output terminal B. The first driving sub-circuit 3102 may receive a first data signal at a first data signal terminal Vdata1, receive a first scanning signal at a first scanning signal terminal Vscan1, and generate a driving signal at the driving signal output terminal B or perform threshold voltage compensation on the second pixel driving sub-circuit 320' under control of the first data signal, the first scanning signal, and the signal at the first control node D.

The second pixel driving sub-circuit 320' comprises a second control sub-circuit 3201 and a second driving sub-circuit 3202. The second control sub-circuit 3201 is connected to a second control signal terminal Vems2 for providing a second control signal, a second power signal terminal VDD2 for providing a second power signal, and a second control node E. The second control sub-circuit 3201 may receive a second control signal at the second control signal terminal Vems2, receive a second power signal at the second power signal terminal VDD2, and output the received second power signal at the second control node E under control of the second control signal. The second driving sub-circuit 3202 is connected to the second control node E and the driving signal output terminal B. The second driving sub-circuit 3202 may be connected to the second data signal terminal Vdata2 and the second scanning signal terminal Vscan2, and generate a driving signal at the driving signal output terminal B or perform threshold voltage compensation on the first pixel driving sub-circuit 310' under control of the signals at the second data signal terminal Vdata2, the second scanning signal terminal Vscan2, and the second control node E.

In FIG. 4, the first driving sub-circuit 3102 comprises a first transistor T1, a second transistor T2, and a first capacitor Cs1, the first control sub-circuit 3101 comprises a third transistor T3, the second driving sub-circuit 3202 comprises a fourth transistor T4, a fifth transistor T5 and a second capacitor Cs2, and the second control sub-circuit 3201 comprises a sixth transistor T6.

The first transistor T1 has a gate connected to the first scanning signal terminal Vscan1 to receive the first scanning signal, a first electrode connected to the first data signal terminal Vdata1 to receive the first data signal, and a second electrode connected to a gate of the second transistor T2, wherein a node between the second electrode of the first transistor T1 and the gate of the second transistor T2 is denoted by A. The second transistor T2 has the gate connected to the node A, a first electrode connected to the first control node D, and a second electrode connected to the driving signal output terminal B. The third transistor T3 has a gate connected to the first control signal terminal Vems1 to receive the first control signal, a first electrode connected to the first power signal terminal VDD1 to receive the first power signal, and a second electrode connected to the first control node D. The first capacitor Cs1 has one terminal connected to the node A, and the other terminal connected to the driving signal output terminal B.

The fourth transistor T4 has a gate connected to the second scanning signal terminal Vscan2 to receive the second scanning signal, a first electrode connected to the second data signal terminal Vdata2 to receive the second data signal, and a second electrode connected to a gate of the fifth transistor, wherein a node between the second electrode of the fourth transistor T4 and the gate of the fifth transistor T5 is denoted by C. The fifth transistor T5 has the gate connected to the node C, a first electrode connected to the second control node E, and a second electrode connected to the driving signal output terminal B. The sixth transistor T6 has a gate connected to the second control signal terminal Vems2 to receive the second control signal, a first electrode connected to the second power signal terminal VDD2 to receive the second power signal, and a second electrode connected to the second control node E. The second capacitor Cs2 has one terminal connected to the node C, and the other terminal connected to the driving signal output terminal B.

Figure 5:
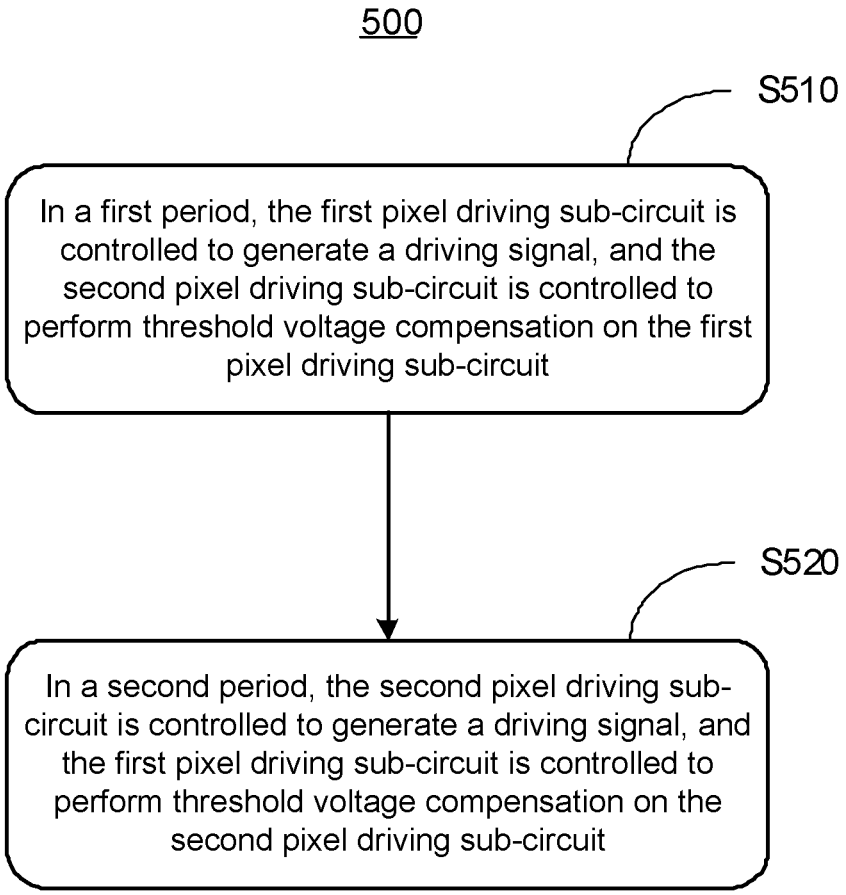
FIG. 5 illustrates a flowchart of a method for controlling a pixel driving circuit according to an embodiment of the present disclosure.

FIG. 5 illustrates a flowchart of a method 500 for controlling a pixel driving circuit according to an embodiment of the present disclosure. The method 500 may be applied to the above pixel driving circuit, for example, the pixel driving circuit 300 or 300'.

In step S510, in a first period, the first pixel driving sub-circuit is controlled to generate a driving signal to drive the light emitting element, and the second pixel driving sub-circuit 320 is controlled to perform threshold voltage compensation on the first pixel driving sub-circuit.

In step S520, in a second period, the second pixel driving sub-circuit is controlled to drive the light emitting element, and the first pixel driving sub-circuit is controlled to perform threshold voltage compensation on the second pixel driving sub-circuit.

For example, the first period and the second period may be different frames, for example, the first period is an odd frame, the second period is an even frame, or the first period is an even frame, and the second period is an odd frame. Although steps S510 and S520 are described above in a specific order, the embodiments of the present disclosure are not limited thereto, and an order of execution of steps S510 and S520 may be selected as needed.

An example of an operation (for example, step S510 described above) performed by a method for controlling a pixel driving circuit in a first period according to an embodiment of the present disclosure will be described below with reference to FIGS. 6, 7, and 8A-8D.

Figure 6:
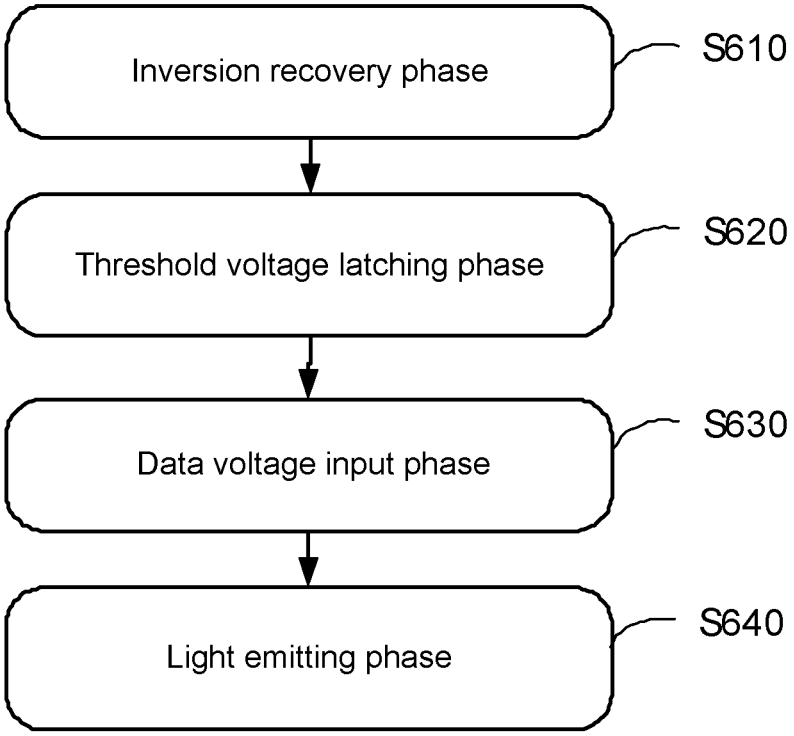
FIG. 6 illustrates an exemplary flowchart of an operation performed by a method for controlling a pixel driving circuit in a first period according to an embodiment of the present disclosure.
Figure 7:
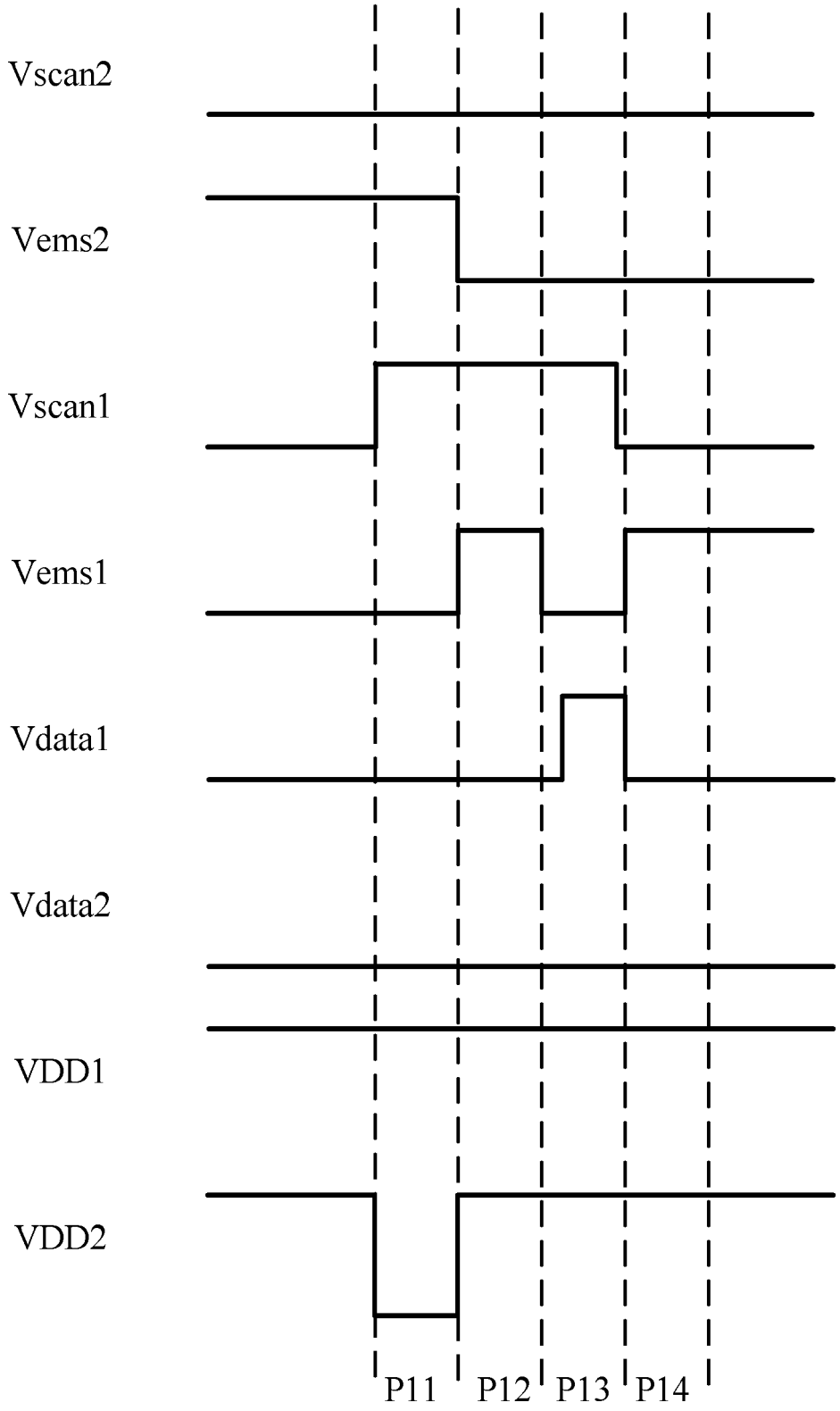
FIG. 7 illustrates a signal timing diagram of the operation of FIG. 6.

FIG. 6 illustrates an exemplary flowchart of an operation performed by a method for controlling a pixel driving circuit in a first period according to an embodiment of the present disclosure. FIG. 7 illustrates a signal timing diagram of FIG. 6. FIGS. 8A-8D illustrate equivalent circuit diagrams of the pixel driving circuit in respective phases in FIG. 7 according to an embodiment of the present disclosure.

Figure 8A:
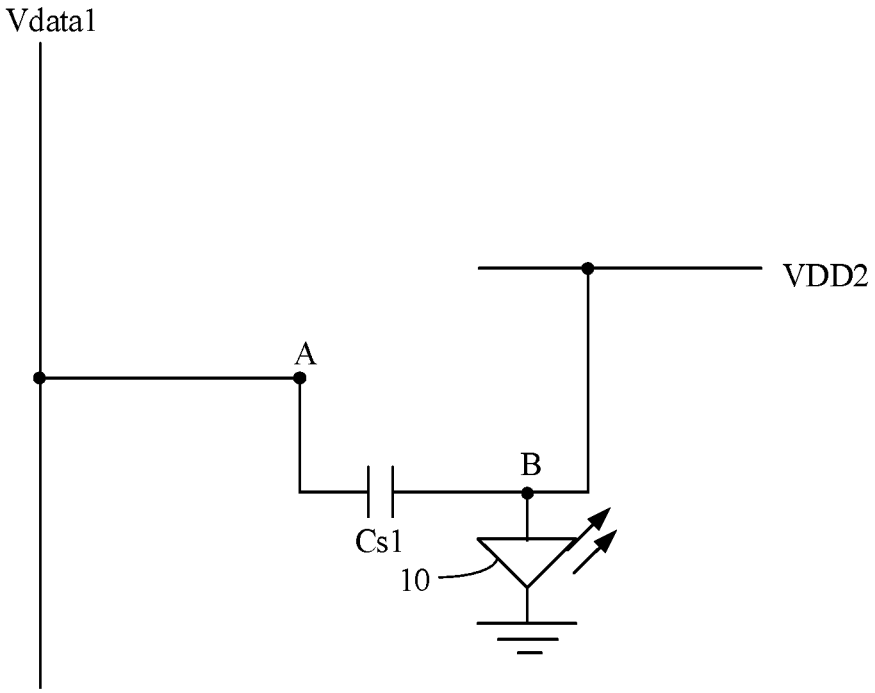
FIGS. 8A-8D illustrate equivalent circuit diagrams of the pixel driving circuits in respective phases in FIG. 7 according to an embodiment of the present disclosure.

In step S610, in an inversion recovery phase P11, the first scanning signal terminal Vscan1 is at a high level, the second scanning signal terminal Vscan2 is at a low level, the first control signal terminal Vems1 is at a low level, and the second control signal terminal Vems2 is at a high level, so that the first transistor T1 and the sixth transistor T6 are turned on, and the third transistor T3 and the fourth transistor T4 are turned off. The second transistor T2 is turned off under action of the level at the first data signal terminal Vdata1. For example, the level at the first data signal terminal Vata1 may be zero volts, so that the level at the node A is also zero volts, and thereby the second transistor T2 is turned off. Since the second pixel driving sub-circuit 320 is used to drive the light emitting element 10 of the pixel in a previous frame, the fifth transistor T5 is in a turn-on state at this time. The second power signal terminal VDD2 is at a reference level Vref (for example, a negative level), so that the driving signal output terminal B is at the reference level Vref, and thereby the driving signal output terminal B is inverted to be at a negative level. In order to be able to latch a threshold voltage Vth1 of the second transistor T2 in a subsequent step, magnitude of the reference level Vref may be set so that a level VB at the driving signal output terminal B is set to satisfy |VB|>|Vth1| at this time, for example, the reference level Vref at the driving signal output terminal B may be set to be less than −Vth1. In the inversion recovery phase, an equivalent circuit of the pixel driving circuit (for example, the pixel driving circuit 300') is as shown in FIG. 8A. In the inversion recovery phase, a polarity of the light emitting element 10 is inverted by changing a voltage at an input terminal (and thereby the driving signal output terminal B) of the light emitting element to a negative value, thereby avoiding charge accumulation caused by positive bias current, which stabilizes light emitting characteristics of the light emitting element 10.

Figure 8B:
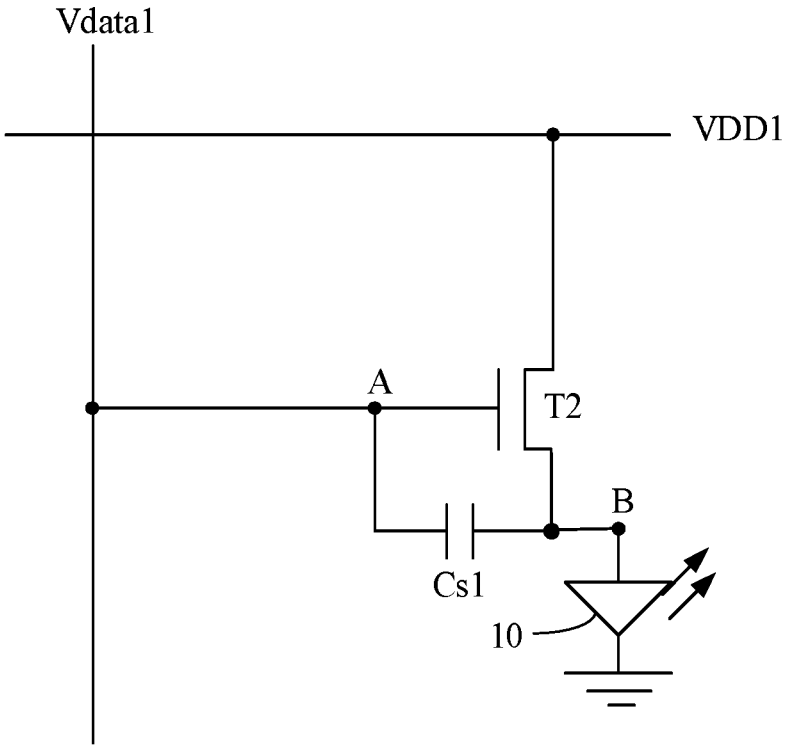

In step S620, in a threshold voltage latching phase P12, the first scanning signal terminal Vscan1 is at a high level, the second scanning signal terminal Vscan2 is at a low level, the first control signal terminal Vems1 is at a high level, and the second control signal terminal Vems2 is at a low level, so that the first transistor T1 and the third transistor T3 are turned on, and the fourth transistor T4 and the sixth transistor T6 are turned off. The first data signal terminal Vdata1 is maintained at, for example, zero volts, so that the voltage at the node A does not change. However, since the reference level Vref at the driving signal output terminal B is less than −Vth1 at this time, a gate-source voltage Vgs of the second transistor T2 is equal to 0-Vref>Vth1, and the second transistor T2 is turned on. Since the sixth transistor T6 is turned off, the second power signal at the second power signal terminal VDD2 is no longer provided to the driving signal output terminal B. At this time, the first power signal which is at a high level at the first power signal terminal VDD1 is provided to the driving signal output terminal B, and the level at the driving signal output terminal B increases under action of the high level at the first power signal terminal VDD1 until the second transistor T2 is turned off. At this time, Vgs=Vth1, that is, the level at the driving signal output terminal B becomes Vth1, and the threshold voltage of the second transistor T2 is latched in the first capacitor Cs1. In the threshold voltage latching phase, an equivalent circuit of the above pixel driving circuit is as shown in FIG. 8B.

Figure 8C:
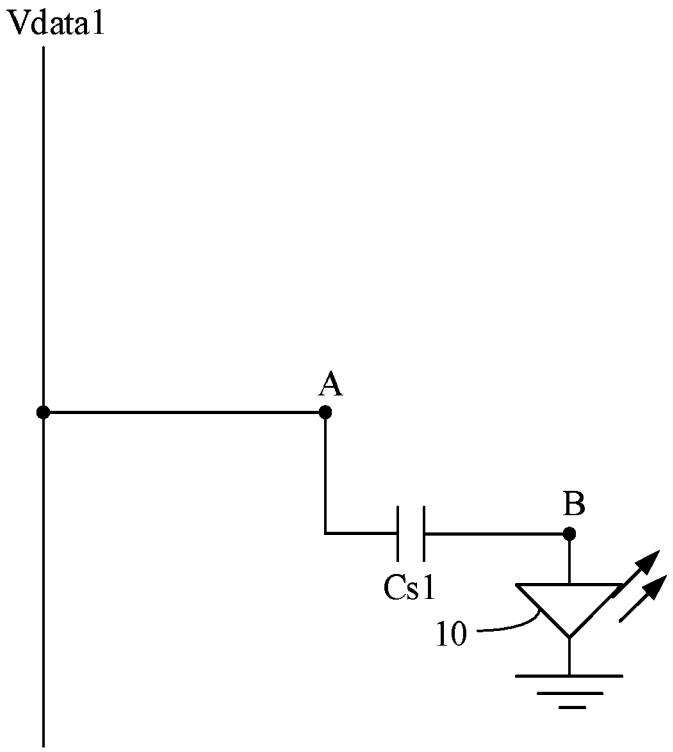

In step S630, in a data voltage input phase P13, the first scanning signal terminal Vscan1 is at a high level, the second scanning signal terminal Vscan2 is at a low level, the first control signal terminal Vems1 is at a low level, and the second control signal terminal Vems2 is at a low level, so that the first transistor T1 is turned on, and the third transistor T3, the fourth transistor T4, and the sixth transistor T6 are turned off. A data signal at a level Vd1-1 (greater than, for example, zero volts) is applied to the first data signal terminal Vdata1, and the level Vd1-1 at the first data signal terminal Vdata1 is input to the node A, so that the level at the node A is Vd1-1. In the data voltage input phase, an equivalent circuit of the above pixel driving circuit is as shown in FIG. 8C. At this time, the first capacitor Cs1 is connected in series with the equivalent capacitor Coled of the light emitting element 10. Due to the capacitive coupling effect, the level at the driving signal output terminal B changes from −Vth1 to VB1=−Vth1+$C_{S1}/(C_{S1}+C_{OLED})\times$Vd1-1, where $C_{S1}$ represents capacitance of the first capacitor Cs1, and $C_{OLED}$ represents capacitance of the equivalent capacitor Coled.

At this time, a voltage difference across the first capacitor Cs1 is:

$$Vd1\text{-}1-VB1=Vth1+C_{OLED}/(C_{S1}+C_{OLED})\times Vd1\text{-}1.$$

In order to prevent the light emitting element 10 from unnecessarily emitting light in this phase, it may be restricted that VB1<Vth_oled, that is, the voltage at the driving signal output terminal B is less than a light emitting threshold voltage Vth_oled of the light emitting element.

Figure 8D:
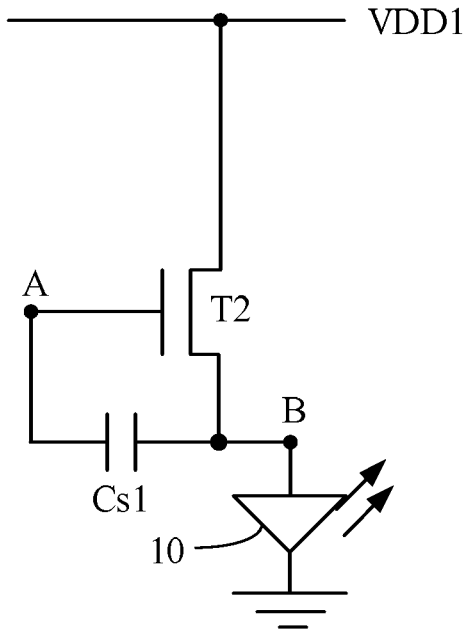

In step S640, in a light emitting phase P14, the first scanning signal terminal Vscan1 is at a low level, the second scanning signal terminal Vscan2 is at a low level, the first control signal terminal Vems1 is at a high level, and the second control signal terminal Vems2 is at a low level, so that the third transistor T3 is turned on, and the first transistor T1, the fourth transistor T4, and the sixth transistor T6 are turned off. At this time, due to the bootstrap effect, the voltage across the first capacitor Cs1 is maintained to be unchanged at Vth1+$C_{OLED}/(C_{S1}+C_{OLED})\times$Vd1-1 until the light emitting phase ends. This keeps the second transistor T2 always in a saturation region. In the light emitting phase, an equivalent circuit of the above pixel driving circuit is as shown in FIG. 8D. At this time, the first power signal terminal VDD1 is at a high level, so that the level at the driving signal output terminal B continuously increases, and when the level at the driving signal output terminal B increases to an extent that the voltage difference across the light emitting element 10 reaches the light emitting threshold voltage of the light emitting element 10, the light emitting element 10 starts to emit light. The light emitting current holed passing through the light emitting element 10 is calculated as follows:

$$\begin{aligned} Ioled &= K(Vgs-Vth1)^2 \\ &= K(Vth1+C_{OLED}/(C_{S1}+C_{OLED})\times Vd1-1-Vth1)^2 \\ &= K(C_{OLED}/(C_{S1}+C_{OLED})\times Vd1-1)^2 \end{aligned}$$

where $$K=\frac{1}{2}\mu_n C_{ox}\left(\frac{W}{L}\right),$$

$\mu_n$ represents an electron mobility of a transistor, $C_{ox}$ represents insulation capacitance per unit area, and $$\frac{W}{L}$$

represents an aspect ratio of the transistor. In the above formula, K is calculated for a driving transistor (i.e., the second transistor T2).

Thus, the light emitting current holed is independent of the threshold voltage Vth1 of the second transistor T2.

In one embodiment, as shown in FIG. 7, in a light emitting phase P14, a falling edge of the first scanning signal at the first scanning signal terminal Vscan1 may be earlier than a rising edge of the first control signal at the first control signal terminal Vems1, thus avoiding a competitive risk phenomenon.

Another example of an operation (for example, step S510 described above) performed by a method for controlling a pixel driving circuit in a first period according to an embodiment of the present disclosure will be described below with reference to FIGS. 9 and 10.

Figure 9:
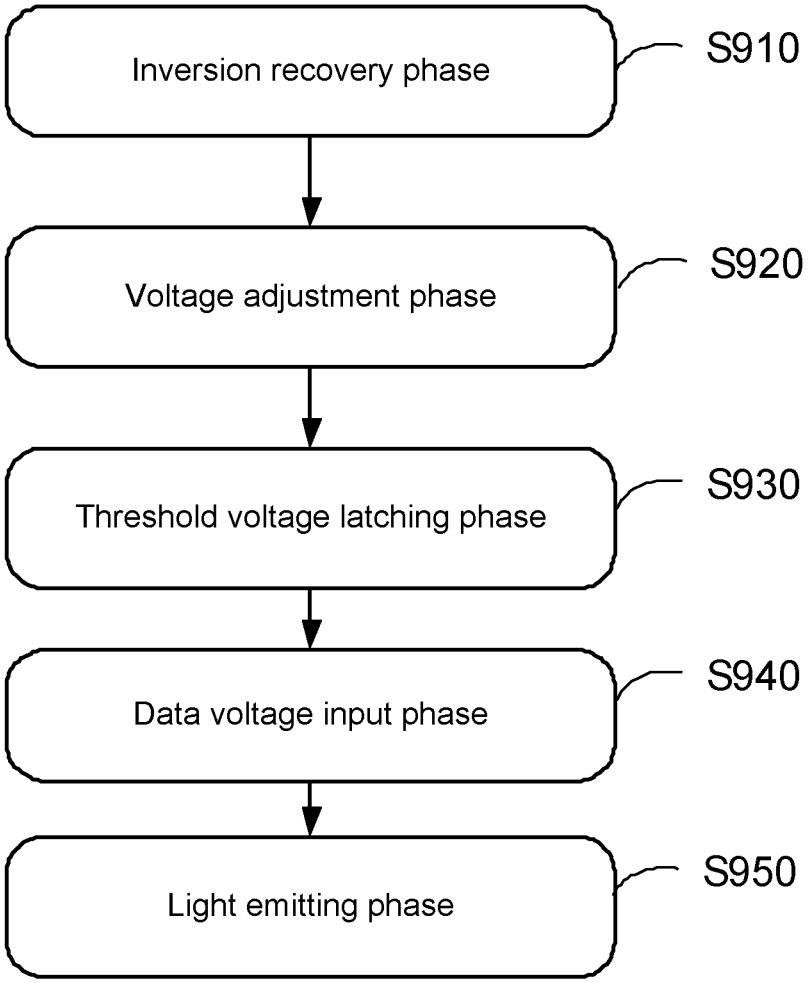
FIG. 9 illustrates another exemplary flowchart of an operation performed by a method for controlling a pixel driving circuit in a first period according to an embodiment of the present disclosure.

FIG. 9 illustrates another exemplary flowchart of an operation performed by a method for controlling a pixel driving circuit in a first period according to an embodiment of the present disclosure. FIG. 10 illustrates a signal timing diagram of the operation of FIG. 9. The method for controlling a pixel driving circuit of FIGS. 9 and 10 is similar to the method for controlling a pixel driving circuit described above with reference to FIGS. 6, 7, and 8A-8D, except at least that the method of FIGS. 9 and 10 further comprises a voltage adjustment phase between the inversion recovery phase and the threshold voltage latching phase. For the sake of brevity, the difference portions will be primarily described in detail below.

Figure 10:
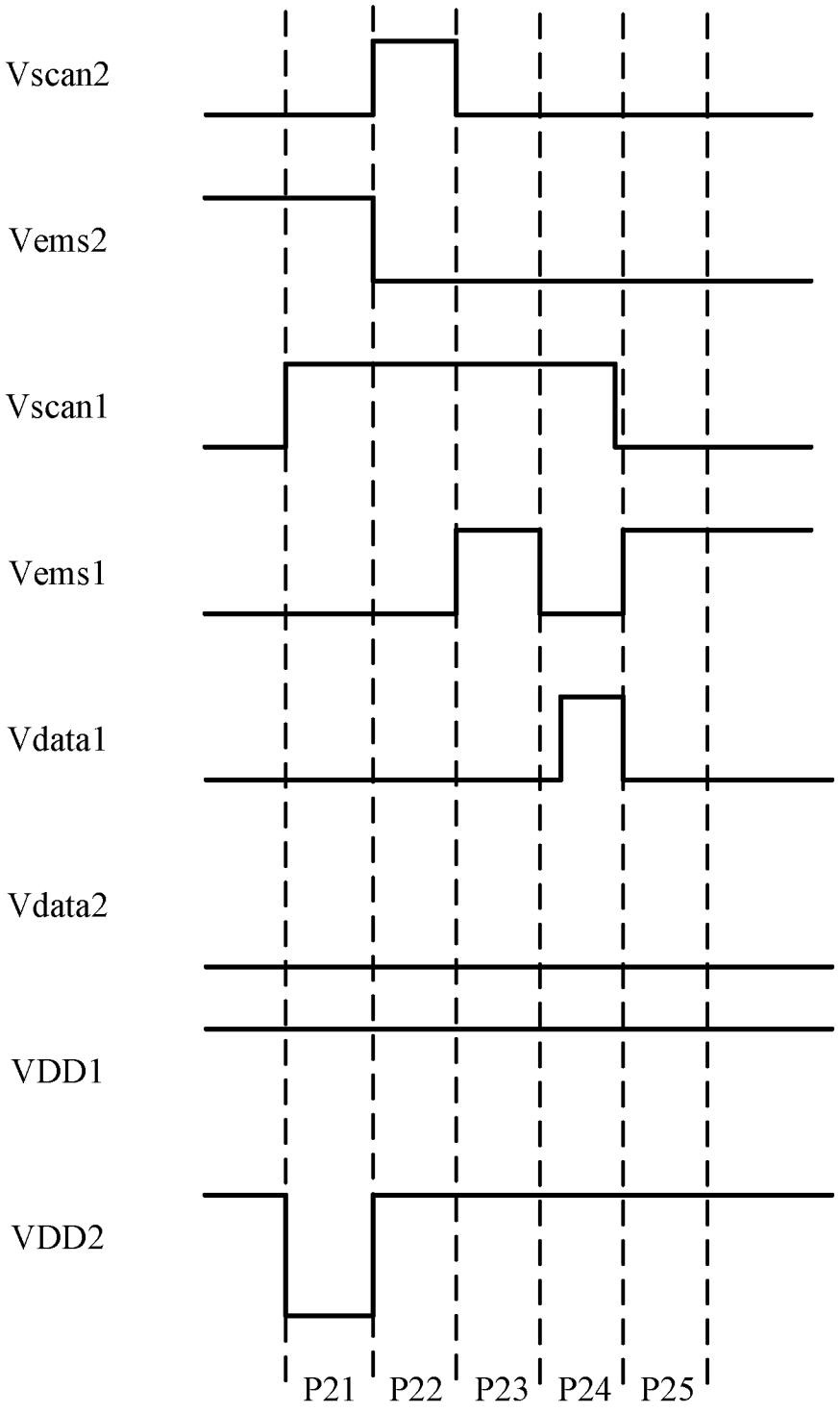
FIG. 10 illustrates a signal timing diagram of the operation of FIG. 9.

As shown in FIGS. 9 and 10, another example of the operation performed by the method for controlling a pixel driving circuit in the first period according to an embodiment of the present disclosure comprises steps S910 to S950, wherein steps S910 (inversion recovery phase P21), S930 (threshold voltage latching phase P23), S940 (data voltage input phase P24), and S950 (light emitting phase P25) may be performed in the same manner as steps S610, S620, S630, and S640 described above respectively.

In step S920, in a voltage adjustment phase P22, the first scanning signal terminal Vscan1 is at a high level, the second scanning signal terminal Vscan2 is at a high level, the first control signal terminal Vems1 is at a low level, the second control signal terminal Vems2 is at a low level, the first data signal terminal Vdata1 is at a low level, the second data signal terminal Vdata2 is at a low level, the first power signal terminal VDD1 is at a power level, and the second power signal terminal VDD2 is at a power level. Since the second control signal terminal Vems2 is at a low level, the sixth transistor T6 is turned off, and since the second scanning signal terminal Vscan2 is at a high level, the fourth transistor T4 is turned on, and thereby a low level Vd2-2 at the second data signal terminal Vdata2 is provided to the node C, and the level at the driving signal output terminal B decreases to $$VB=\frac{C_{S2}}{C_{S1}+C_{OLED}+C_{S2}}Vd2-2$$

and VB<0 due to the capacitive coupling effect.

An example of an operation (for example, step S520 described above) performed by a method for controlling a pixel driving circuit in a second period according to an embodiment of the present disclosure will be described below with reference to FIGS. 11, 12, and 13A-13D.

Figure 11:
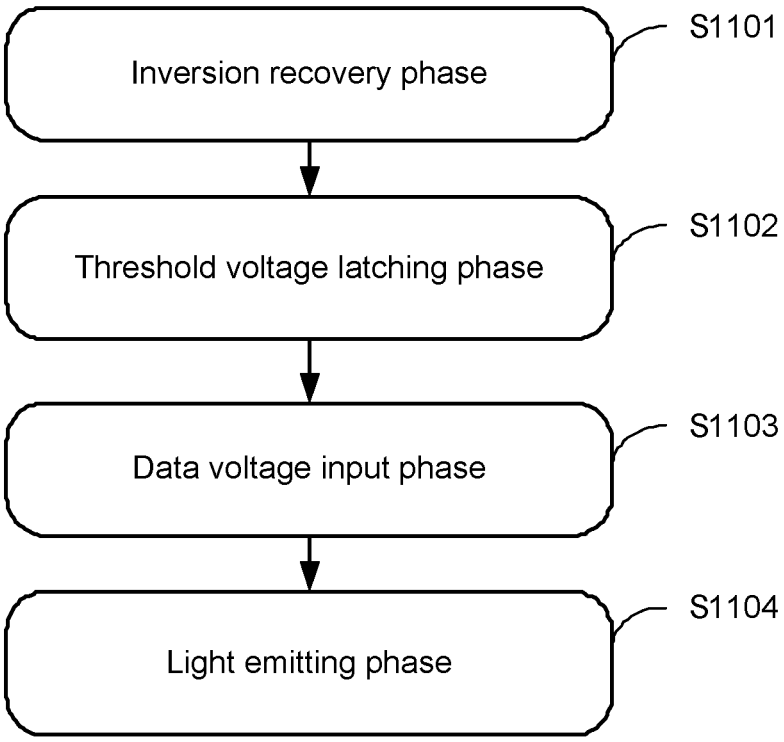
FIG. 11 illustrates a flowchart of an operation performed by a method for controlling a pixel driving circuit in a second period according to an embodiment of the present disclosure.
Figure 12:
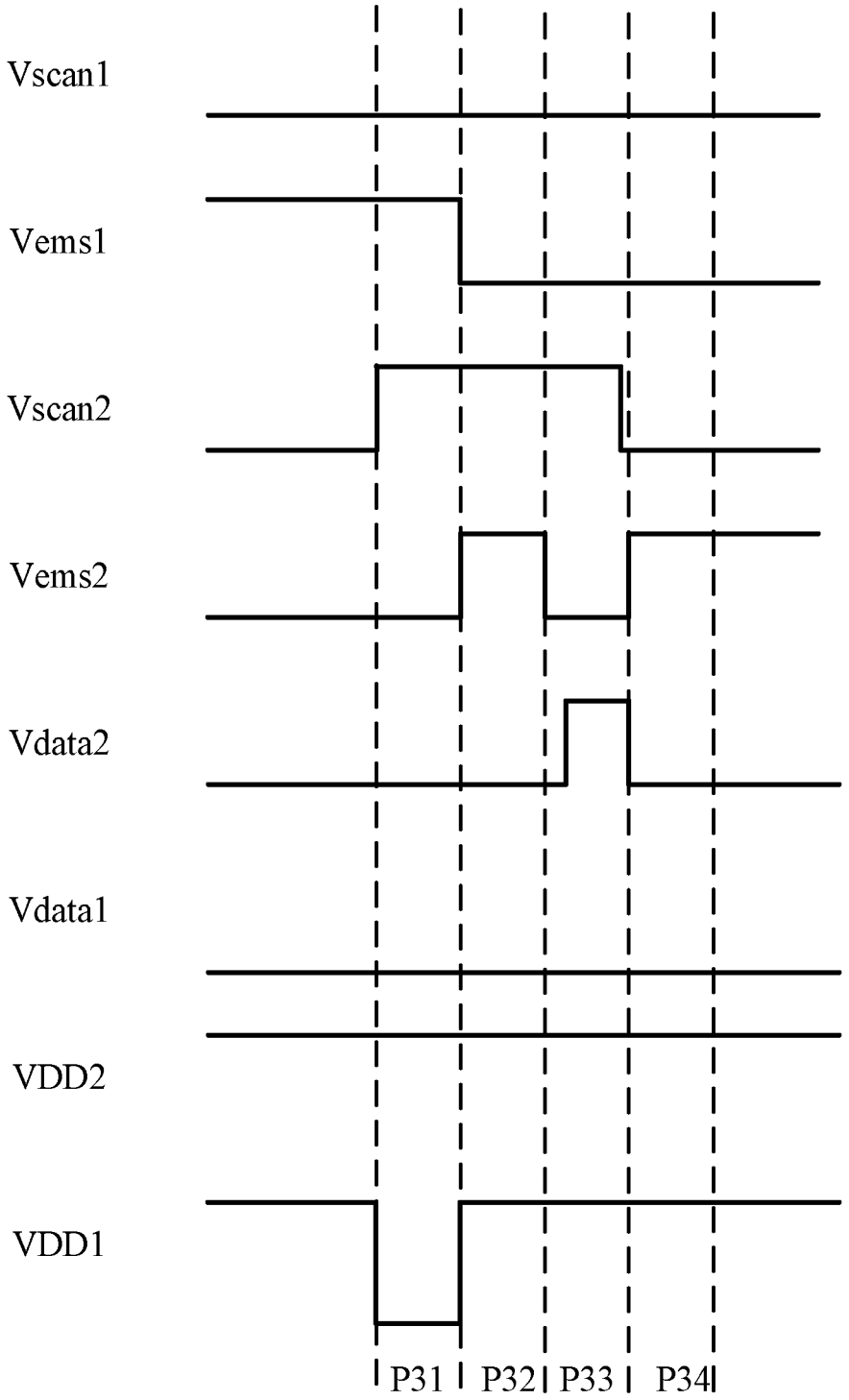
FIG. 12 illustrates a signal timing diagram of the operation of FIG. 11.

FIG. 11 illustrates an exemplary flowchart of an operation performed by a method for controlling a pixel driving circuit in a second period according to an embodiment of the present disclosure. FIG. 12 illustrates a signal timing diagram of the operation of FIG. 11. FIGS. 13A-13D illustrate equivalent circuit diagrams in respective phases in FIG. 11.

Figure 13A:
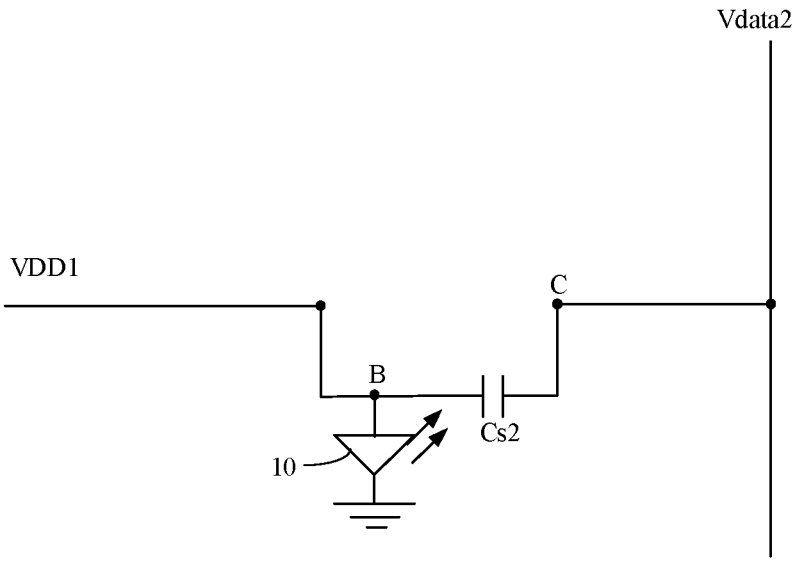
FIGS. 13A-13D illustrate equivalent circuit diagrams in respective phases in FIG. 11.

In step S1101, in an inversion recovery phase P31, the second scanning signal terminal Vscan2 is at a high level, the first scanning signal terminal Vscan1 is at a low level, the second control signal terminal Vems2 is at a low level, and the first control signal terminal Vems1 is at a high level, so that the fourth transistor T4 and the third transistor T3 are turned on, and the sixth transistor T6 and the first transistor T1 are turned off. The second data signal terminal Vdata2 is at, for example, zero volts, so that the level at the node C is zero volts, and thereby the fifth transistor T5 is turned off. Since the first pixel driving sub-circuit 310 is used to drive the light emitting element of the pixel in a previous frame, the second transistor T2 is in a turn-on state at this time. The first power signal terminal VDD1 is at a reference level Vref (for example, a negative level), so that the level at the driving signal output terminal B is the reference level Vref, and thereby the driving signal output terminal B is inverted to be at a negative level. Here, in order to be able to latch a threshold voltage Vth2 of the fifth transistor T5 in a subsequent step, the voltage Vref at the node B is less than −Vth2 at this time, wherein Vth2 is a threshold voltage of the fifth transistor T5. In the inversion recovery phase, an equivalent circuit of the pixel driving circuit is as shown in FIG. 13A.

In the inversion recovery phase, a polarity of the light emitting element 10 is inverted by changing a level at an input terminal (and thereby the driving signal output terminal B) of the light emitting element 10 to a negative value, thereby avoiding charge accumulation caused by positive bias current, which stabilizes light emitting characteristics of the light emitting element 10.

Figure 13B:
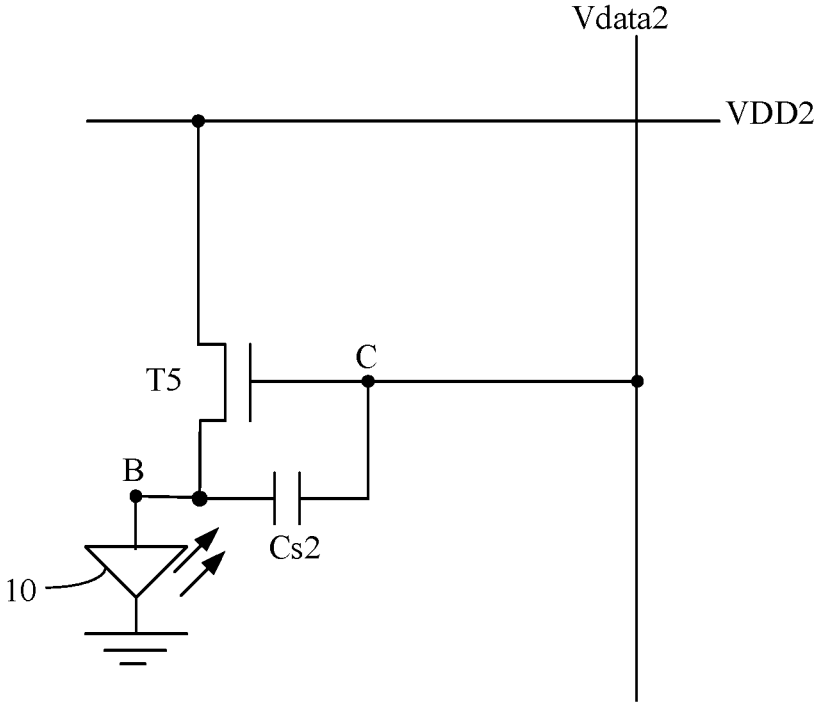

In step S1102, in a threshold voltage latching phase P32, the second scanning signal terminal Vscan2 is at a high level, the first scanning signal terminal Vscan1 is at a low level, the second control signal terminal Vems2 is at a high level, and the first control signal terminal Vems1 is at a low level, so that the fourth transistor T4 and the sixth transistor T6 are turned on, and the first transistor T1 and the third transistor T3 are turned off. The second data signal terminal Vdata2 is maintained to be unchanged, so that the level at the node C does not change. However, since the level Vref at the driving signal output terminal B is less than −Vth2 at this time, a gate-source voltage Vgs of the fifth transistor T5 is greater than Vth2, and the fifth transistor T5 is turned on. Since the third transistor T3 is turned off, the first power signal at the first power signal terminal VDD1 is no longer provided to the driving signal output terminal B, and the second power signal at the second power signal terminal VDD2 is provided to the driving signal output terminal B. The level at the driving signal output terminal B increases under action of the high level at the second power signal terminal VDD2 until the fifth transistor T5 is turned off. At this time, Vgs=Vth2, that is, the level at the driving signal output terminal B becomes Vth2, and the threshold voltage of the fifth transistor T5 is latched in the second capacitor Cs2. In the threshold voltage latching phase, an equivalent circuit of the above pixel driving circuit is as shown in FIG. 13B.

Figure 13C:
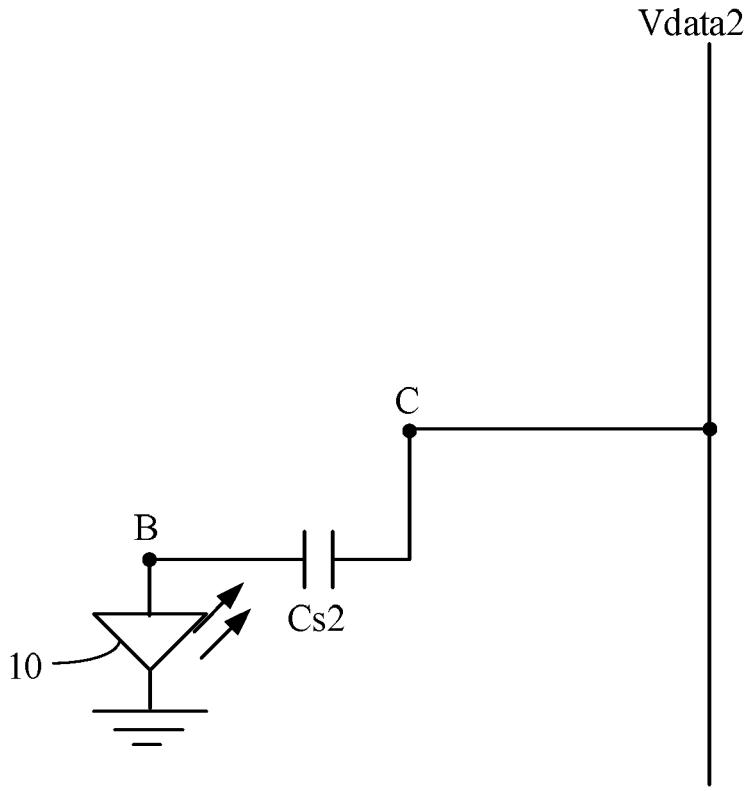

In step S1103, in a data voltage input phase P33, the second scanning signal terminal Vscan2 is at a high level, the first scanning signal terminal Vscan1 is at a low level, the second control signal terminal Vems2 is at a low level, and the first control signal terminal Vems1 is at a low level, so that the fourth transistor T4 is turned on, and the third transistor T3, the first transistor T1, and the sixth transistor T6 are turned off. A second data signal at a level Vd2-1 (greater than, for example, zero volts), is applied to the second data signal terminal Vdata2, and the level at the second data signal terminal Vdata2 is input to the node C, so that the level at the node C becomes Vd2-1. In the data voltage input phase, an equivalent circuit of the above pixel driving circuit is as shown in FIG. 13C. The second capacitor Cs2 is connected in series with the equivalent capacitor Coled of the light emitting element 10. Due to the capacitive coupling effect, the level at the driving signal output terminal B changes from −Vth2 to VB2=−Vth2+$C_{S2}$/($C_{S2}$+$C_{OLED}$)×Vd2-1 where $C_{S2}$ represents capacitance of the second capacitor Cs2, and $C_{OLED}$ represents capacitance of the equivalent capacitor Coled.

At this time, a voltage difference across the second capacitor Cs2 is:

$$Vd2\text{-}1-VB2==Vth2+C_{OLED}/(C_{S2}+C_{OLED})\times Vd2\text{-}1.$$

In order to prevent the light emitting element from unnecessarily emitting light in this phase, it may be restricted that VB2<Vth_oled, that is, the voltage at the driving signal output terminal B is less than a light emitting threshold voltage of the light emitting element.

Figure 13D:
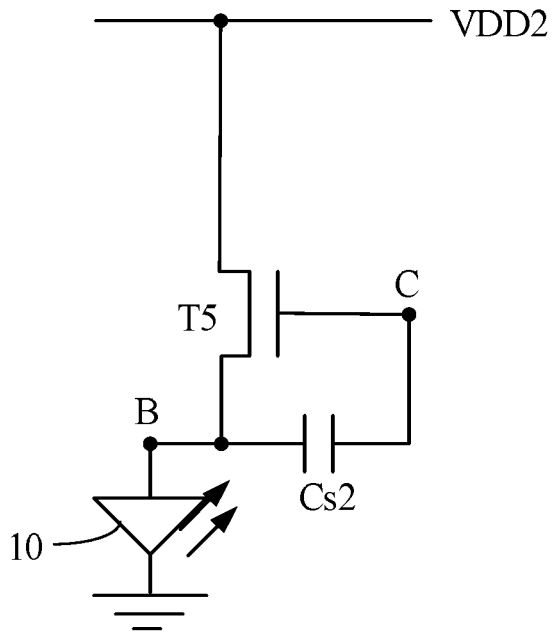

In step S1104, in a light emitting phase P34, the second scanning signal terminal Vscan2 is at a low level, the first scanning signal terminal Vscan1 is at a low level, the second control signal terminal Vems2 is at a high level, and the first control signal terminal Vems1 is at a low level, so that the sixth transistor T6 is turned on, and the first transistor T1, the fourth transistor T4, and the third transistor T3 are turned off. In the light emitting phase, an equivalent circuit of the above pixel driving circuit is as shown in FIG. 13D. Due to the bootstrap effect, the voltage across the second capacitor Cs2 is maintained to be unchanged at Vth2+$C_{OLED}$/($C_{S2}$+$C_{OLED}$)×Vd2-1 until the light emitting phase ends. This keeps the fifth transistor T5 always in a saturation region. At this time, the second power signal terminal VDD2 is at a high level, so that the level at the driving signal output terminal B continuously increases, and when the level at the driving signal output terminal B reaches the light emitting threshold voltage of the light emitting element 10, the light emitting element 10 starts to emit light. The light emitting current holed passing through the light emitting element 10 is calculated as follows:

$$\begin{aligned} Ioled &= K(Vgs - Vth2)^2 \\ &= K(Vth2 + C_{OLED}/(C_{S2} + C_{OLED}) \times Vd2 - 1 - Vth2)^2 \\ &= K(C_{OLED}/(C_{S2} + C_{OLED}) \times Vd2 - 1)^2 \end{aligned}$$

where $$K = \frac{1}{2}\mu_n C_{ox}\left(\frac{W}{L}\right),$$

$\mu_n$ represents an electron mobility of a transistor, $C_{ox}$ represents insulation capacitance per unit area, and $$\frac{W}{L}$$

represents an aspect ratio of the transistor. In the above formula, K is calculated for a driving transistor (i.e., the fifth transistor T5).

Thus, the light emitting current holed is independent of the threshold voltage Vth2 of the fifth transistor T5.

In one embodiment, in a light emitting phase P34, a falling edge at the second scanning signal terminal Vscan2 may be earlier than a rising edge at the second control signal terminal Vems2, thus avoiding a competitive risk phenomenon.

The present disclosure further provides a display driving circuit comprising a plurality of the pixel driving circuits described above, which are arranged in an N×M array, where N and M are positive integers. The display driving circuit according to the embodiment of the present disclosure may be included in a display panel and the display driving circuit is configured to drive a plurality of light emitting elements in the display panel. For example, the display panel may comprise a plurality of light emitting elements arranged in an N×M array and a plurality of the pixel driving circuits arranged in an N×M array, wherein each of the pixel driving circuits drives a respective light emitting element.

The display driving circuit according to the embodiment of the present disclosure will be described below with reference to FIG. 14.

Figure 14:
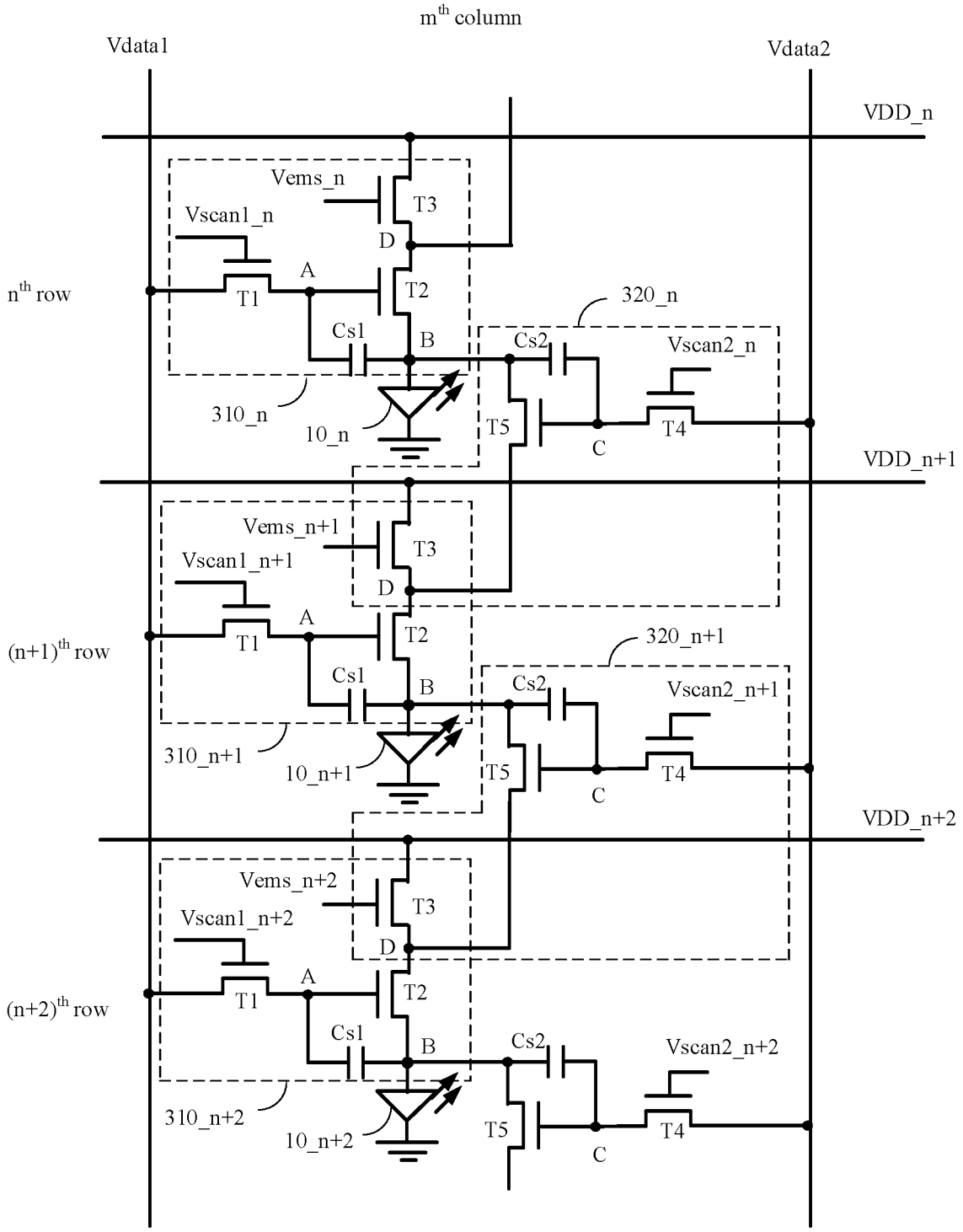
FIG. 14 illustrates a circuit diagram of a display driving circuit according to an embodiment of the present disclosure.

FIG. 14 illustrates an exemplary circuit diagram of a display driving circuit according to an embodiment of the present disclosure. In FIG. 14, the display driving circuit comprises a plurality of pixel driving circuits arranged in an N×M array, wherein each of the pixel driving circuits is used to drive a respective light emitting element. For the sake of brevity, there are only illustrated adjacent three rows of pixel driving circuits in the same column, that is, a pixel driving circuit P(n, m) in an $n^{th}$ row and an $m^{th}$ column in the array, a driving circuit P(n+1, m) in an $(n+1)^{th}$ row and the $m^{th}$ column in the array, and a pixel driving circuit P(n+2, m) in an $(n+2)^{th}$ row and the $m^{th}$ column in the array, where n is a positive integer greater than or equal to 1 and less than or equal to N−2, and m is a positive integer greater than or equal to 1 and less than or equal to M.

As shown in FIG. 14, the pixel driving circuit P(n, m) for driving a light emitting element 10_*n* comprises a first pixel driving sub-circuit 310_*n* and a second pixel driving sub-circuit 320_*n*, the pixel driving circuit P(n+1, m) for driving a light emitting element 10_*n*+1 comprises a first pixel driving sub-circuit 310_*n*+1 and a second pixel driving sub-circuit 320_*n*+1, and the pixel driving circuit P(n+2, m) for driving a light emitting element 10_*n*+2 comprises a first pixel driving sub-circuit 310_*n*+2 and a second pixel driving sub-circuit 320_*n*+2.

According to an embodiment of the present disclosure, two adjacent rows of pixels in the same column may be driven by some common elements to simplify a structure of the display driving circuit and save screen space.

As shown in FIG. 14, each of the pixel driving sub-circuits may have the structure described above with reference to FIGS. 3 and 4, in which a second control sub-circuit of the pixel driving circuit P(n, m) is multiplexed as a first control sub-circuit of the pixel driving circuit P(n+1, m) (in the example of FIG. 14, a transistor T3 located in the $(n+1)^{th}$ row and the $m^{th}$ column not only acts as the second control sub-circuit of the pixel driving circuit P(n, m), but also acts as the first control sub-circuit of the pixel driving circuit P(n+1, m)), a second power signal terminal of the pixel driving circuit P(n, m) is multiplexed as a first power signal terminal of the pixel driving circuit P(n+1, m) (in the example of FIG. 14, a power signal terminal for providing a power signal VDD_n+1 not only acts as the second power signal terminal of the pixel driving circuit P(n, m), but also acts as the first power signal terminal of the pixel driving circuit P (n+1, m)), and a second control node of the pixel driving circuit P(n, m) is multiplexed as a first control node of the pixel driving circuit P(n+1, m) (in the example of FIG. 14, a node B located in the $(n+1)^{th}$ row and the $m^{th}$ column not only acts as the second control node of the pixel driving circuit P(n, m), but also acts as the first control node of the pixel driving circuit P(n+1, m)).

The embodiments of the present disclosure further provide a method for controlling the display driving circuit described above. The method comprises: scanning the plurality of pixel driving circuits in the display driving circuit, wherein for each scanned pixel driving circuit, controlling, in a first period, a first pixel driving sub-circuit to generate a driving signal and controlling a second pixel driving sub-circuit to perform threshold voltage compensation on the first pixel driving sub-circuit; and controlling, by a control signal, in a second period, the second pixel driving sub-circuit to generate a driving signal, and controlling the first pixel driving sub-circuit to perform threshold voltage compensation on the second pixel driving sub-circuit.

The method for controlling a display driving circuit according to the embodiment of the present disclosure will be described below with reference to FIG. 15. This method may be applied to any of the display driving circuits described above.

In step S1501, it is determined whether a current frame is an odd frame or an even frame. If it is an odd frame, step S1502 is performed; otherwise, step S1505 is performed.

In step S1502, a row of pixel driving circuits is scanned from, for example, a first row, wherein for each pixel driving circuit in the row of pixel driving circuits, a first pixel driving sub-circuit is controlled to generate a driving signal, and a second pixel driving sub-circuit is controlled to perform threshold voltage compensation on the first pixel driving sub-circuit.

In step S1503, it is determined whether the scanning in the current frame is completed, that is, whether a row which is scanned currently is a last row, and if so, step S1508 is performed; otherwise, step S1504 is performed.

In step S1504, the procedure returns to step S1502 for a next row.

In step S1505, similarly to step S1502, a row of pixel driving circuits is scanned from, for example, a first row. However, differently from step S1502, in step S1505, for each pixel driving circuit in the row of pixel driving circuits, a second pixel driving sub-circuit is controlled to generate a driving signal, and a first pixel driving sub-circuit is controlled to perform threshold voltage compensation on the second pixel driving sub-circuit.

In step S1506, it is determined whether the scanning is completed, that is, whether a row which is scanned currently is a last row, and if so, step S1508 is performed; otherwise, step S1507 is performed.

In step S1507, the procedure returns to step S1505 for a next row.

In step S1508, it is determined whether scanning in all frames is completed, that is, whether the current frame is a last frame, and if so, the procedure ends; otherwise, step S1509 is performed.

In step S1509, the procedure returns to step S1501 for a next row.

Figure 15:
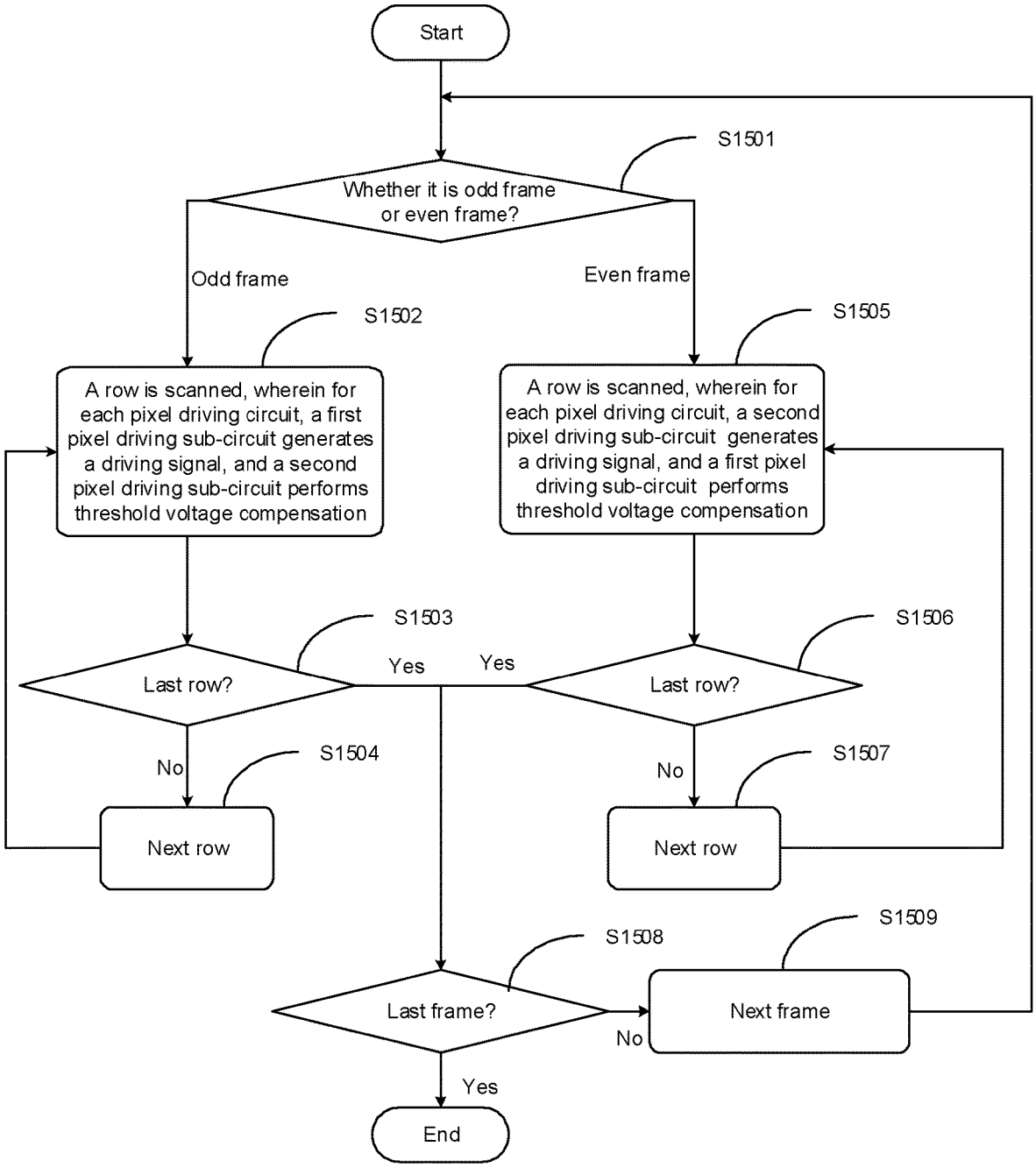
FIG. 15 illustrates a flowchart of a method for controlling a display driving circuit according to an embodiment of the present disclosure.

In FIG. 15, the description is made in a progressive scanning manner in which an odd frame is taken as a first period and an even frame is taken as a second period. However, the embodiments of the present disclosure are not limited thereto, and the scanning manner and the definitions of the first period and the second period may be selected as needed.

In the method of FIG. 15, different rows of pixel driving circuits are not driven at the same time. Although the third transistor T3 is shared by different rows of pixel driving circuits, the common third transistor T3 may not operate in two pixel driving circuits at the same time.

For a display driving circuit in which, for example, the pixel driving circuits of FIGS. 3 and 4 are used and adjacent rows of pixel driving circuits do not share elements, the respective pixel driving circuits may be controlled using the method described above with reference to FIGS. 6 to 13D.

For a display driving circuit in which adjacent rows of pixel driving circuits shares a control sub-circuit, for example, for the display driving circuit shown in FIG. 14, since the second control sub-circuit of the pixel driving circuit P(n, m) and the first control sub-circuit of the pixel driving circuit P(n+1, m) are implemented as the same circuit (for example, the transistor T3), the method may be adjusted accordingly.

For example, since the transistor T3 is shared, in a frame in which driving is performed using the second pixel driving sub-circuit, when the second pixel driving sub-circuit 320_*n* in the pixel driving circuit P(n, m) has been used to drive the light emitting element 10_*n*, and the second pixel driving sub-circuit 320_*n*+1 in the pixel driving circuit P(n+1, m) is to drive the light emitting element 10_*n*+1, a level state of VDD_n+1 of the pixel driving circuit P(n+1, m) may change in the inversion recovery phase for the pixel driving circuit P(n+1, m) (for example, with reference to the timing diagram of FIG. 12, in the reverse recovery phase, VDD_n+1 may change from a high level to a low level), and in other phases of the driving operation of the pixel driving circuit P(n+1, m), a switching state of the third transistor T3 in the pixel driving circuit needs to change from a turn-on state to a turn-off state (with reference to the description made above in connection with FIGS. 12 and 132A-13D, the third transistor T3 is maintained to be turned off in the threshold voltage latching phase, the data voltage input phase, and the light emitting phase). However, due to the sharing of the third transistor T3, the third transistor T3 has also been used in the second pixel driving sub-circuit 320_*n* in the pixel driving circuit P(n, m) for driving the light emitting element 10_*n*, and the level at the power signal terminal VDD_n of the pixel driving circuit P(n+1, m) and the switching state of the third transistor T3 may affect the driving through the second pixel driving sub-circuit 320_*n* of the pixel driving circuit P(n, m), and thereby may affect the light emission of the light emitting element 10_*n*.

It should be understood that in a frame (for example, odd frame) in which driving is performed using the first pixel driving sub-circuit, in the inversion recovery phase, the second pixel driving sub-circuit 320_*n* of the pixel driving circuit P(n, m) performs a discharging operation at the driving signal output terminal B. Since the transistor T3 is shared by the second pixel driving sub-circuit 320_*n* of the pixel driving circuit P(n, m) and the first pixel driving sub-circuit 310_*n*+1 of the pixel driving circuit P(n+1, m) which has not changed to perform driving using the first pixel driving sub-circuit 310_*n*+1, a switching state of the second pixel driving sub-circuit 320_*n* may not affect the light emission of the light emitting element 10_*n*+1 (the light emitting element 10_*n*+1 is being driven by the second pixel driving sub-circuit 320_*n*+1 at this time). Similarly, the level at the power signal terminal VDD_n of the pixel driving circuit P(n, m) does not affect the light emission of the light emitting element 10_*n*+1.

Therefore, for the display driving circuit in FIG. 14, step S1502 may be implemented in the manner described above with reference to FIGS. 6 to 10 (except for the reference signs of the common elements), and step S1505 may be implemented in a manner which is obtained by appropriately changing the manner described above with reference to FIG. 11 to FIG. 13D, to avoid the influence on the light emission of the pixel.

An operation (for example, step S1502 described above) performed by a method for controlling a display driving circuit for each scanned pixel driving circuit in a first period according to an embodiment of the present disclosure will be described below with reference to FIGS. 16 and 17.

Figure 16:
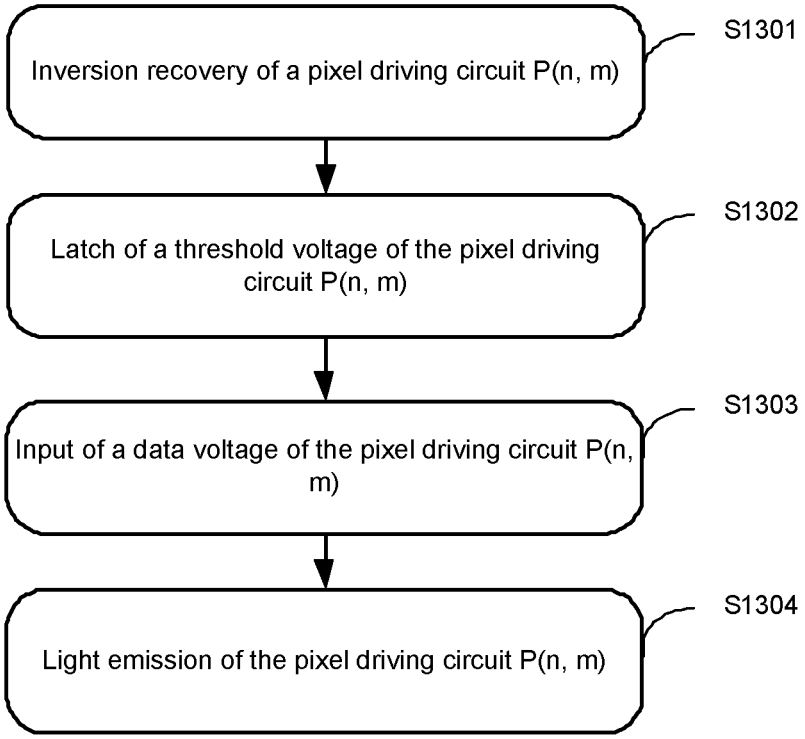
FIG. 16 illustrates a flowchart of an operation performed by a method for controlling a display driving circuit for each scanned pixel driving circuit in a first period according to an embodiment of the present disclosure.
Figure 17:
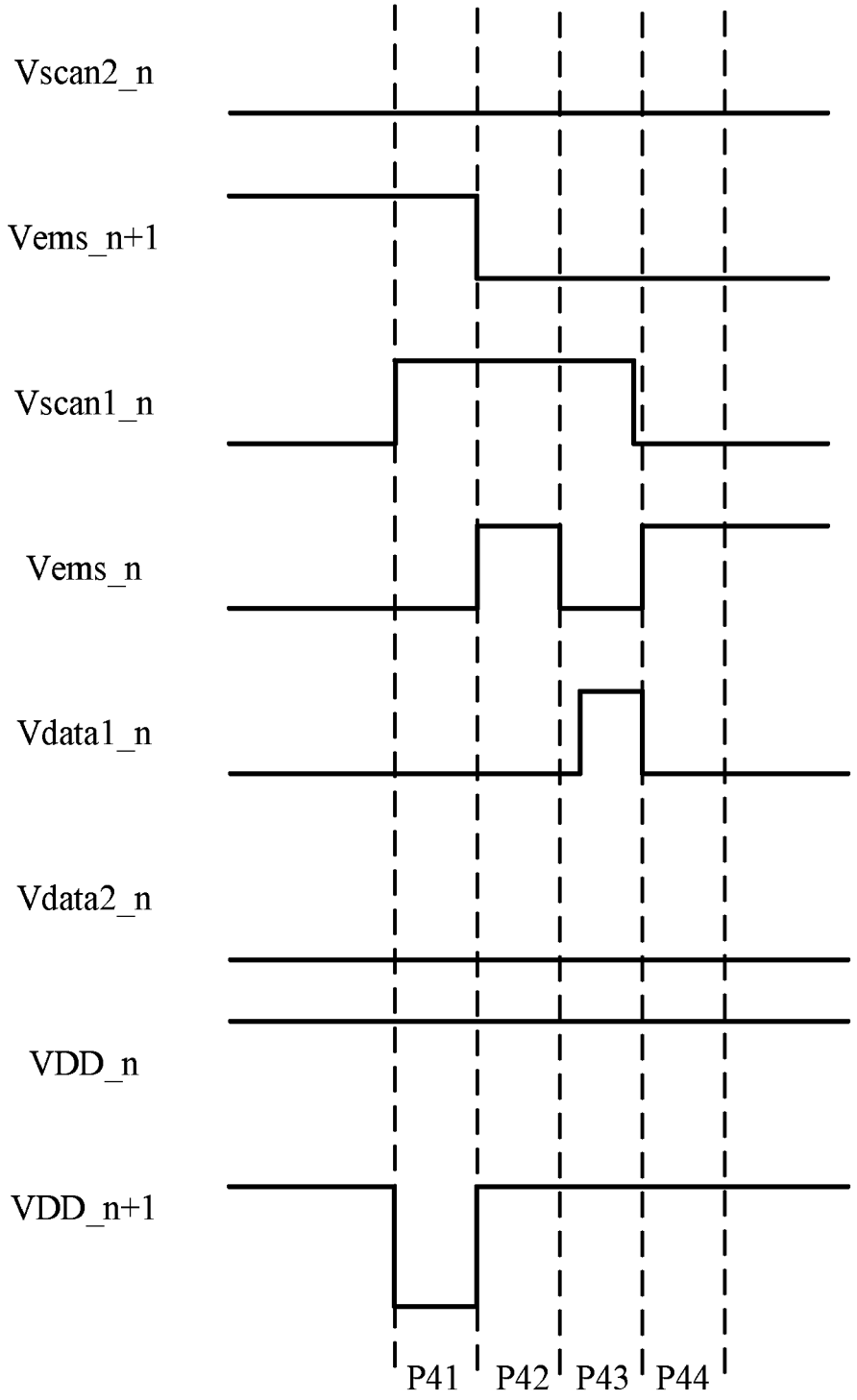
FIG. 17 illustrates a signal timing diagram of the operation of FIG. 16.

FIG. 16 illustrates a flowchart of an operation (for example, step S1502) performed by a method for controlling a display driving circuit for each scanned pixel driving circuit in a first period according to an embodiment of the present disclosure. FIG. 17 illustrates a signal timing diagram of the operation of FIG. 16. Step S1502 may be implemented in the manner described above with reference to FIGS. 6 to 8D. For example, step S1502 comprises an inversion recovery phase, a threshold voltage latching phase, a data voltage input phase, and a light emitting phase, which are implemented in the same manners as steps S610 to S640 respectively (except for the reference signs of the common components), which will be described briefly below. The description of step S510 is also applicable here. The method shown in FIGS. 16 and 17 will be described below in conjunction with the display driving circuit of FIG. 14.

In step S1601, in an inversion recovery phase P41, the first transistor T1 and the fifth transistor T5 of the pixel driving circuit P(n, m) and the third transistor T3 of the pixel driving circuit P(n+1, m) are turned on, the third transistor T3, the second transistor T2, and the fourth transistor T4 of the pixel driving circuit P(n, m) are turned off, and the first power signal terminal VDD_n+1 of the pixel driving circuit P(n+1, m) is at a reference level Vref, so that a polarity of the light emitting element 10_*n* is inverted.

In step S1602, in a threshold voltage latching phase P42, the first transistor T1 and the third transistor T3 of the pixel driving circuit P(n, m) are turned on, the fourth transistor T4 of the pixel driving circuit P(n, m) and the third transistor T3, the second transistor T2, and the fifth transistor T5 of the pixel driving circuit P(n+1, m) are turned off, and the first capacitor Cs1 of the pixel driving circuit P(n, m) is charged until a level at the node A of the pixel driving circuit P(n, m) is higher than a level at the input terminal of the light emitting element 10_*n* by Vth1, wherein Vth1 represents a threshold voltage of the second transistor T2 of the pixel driving circuit P(n, m). This causes the threshold voltage Vth1 to be latched in the first capacitor Cs1 of the pixel driving circuit P(n, m).

In step S1603, in a data voltage input phase P43, the first transistor T1 of the pixel driving circuit P(n, m) is turned on, the third transistor T3 and the fourth transistor T4 of the pixel driving circuit P(n, m) and the third transistor T3, the second transistor T2, and the fifth transistor T5 of the pixel driving circuit P(n+1, m) are turned off, and the level Vd1-1 applied to the first data signal at the first data signal terminal Vdata1 is input to the node A, which causes the level at the node A to become the level Vd1-1, so that the voltage at the input terminal of the light emitting element is adjusted to VB1.

In step S1604, in a light emitting phase P44, the third transistor T3 of the pixel driving circuit P(n, m) is turned on, and the first transistor T1 and the fourth transistor T4 of the pixel driving circuit P(n, m) and the third transistor T3 and the fifth transistor T5 of the pixel driving circuit P(n+1, m) are turned off. Thereby, a voltage across the first capacitor Cs1 of the pixel driving circuit P(n, m) is maintained to be unchanged, so that driving current provided by the second transistor T2 of the pixel driving circuit P(n, m) to the light emitting element 10_*n* is independent of Vth1.

Of course, step S1502 may also be implemented in the manner described above with reference to FIG. 9 and FIG. 10, and details are not described herein again.

An operation (for example, step S1502) performed by a method for controlling a display driving circuit for each scanned pixel driving circuit in a second period according to an embodiment of the present disclosure will be described below with reference to FIGS. 18 and 19.

Figure 18:
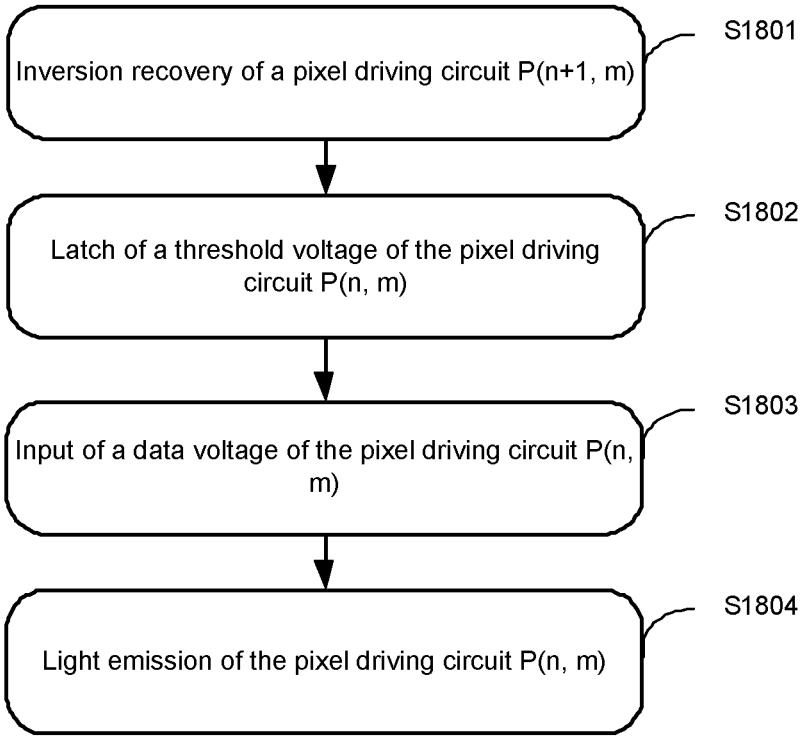
FIG. 18 illustrates a flowchart of an operation performed by a method for controlling a display driving circuit for each scanned pixel driving circuit in a second period according to an embodiment of the present disclosure.

FIG. 18 illustrates a flowchart of an operation (for example, step S1505) performed by a method for controlling a display driving circuit for each scanned pixel driving circuit in a first period according to an embodiment of the present disclosure. FIG. 19 illustrates a signal timing diagram of the operation of FIG. 18. Similarly to FIG. 11, step S1505 comprises an inversion recovery phase, a threshold voltage latching phase, a data voltage input phase, and a light emitting phase, wherein the threshold voltage latching phase, the data voltage input phase, and the light emitting phase are similar to those of FIG. 11 (except for the reference signs of the common elements), except at least that the reverse recovery phase of step S1505 is not used for the pixel driving circuit P(n, m) which is currently to be driven, but for a next pixel driving circuit P(n+1, m) to be driven. This is equivalent to performing the inversion recovery phase in advance (by, for example, one sub-frame). At this time, the second pixel driving sub-circuit which shares elements with the first pixel driving sub-circuit that performs the inversion recovery has not started to drive the pixel to emit light, and may not have an influence on the light emission of the pixel. Further, the level at the control signal terminal Vems_n of the pixel driving circuit P(n, m) is also set to be maintained at a high level throughout the sub-frame in FIG. 19 to avoid the influence on light emission in the pixel P(n−1, m). Here, since the inversion recovery phase for the pixel P(n, m) has been completed in advance by one sub-frame, the second transistor T2 of the pixel P(n+1, m) is no longer turned on in the current sub-frame, and Vems_n is maintained at a high level, and may not have an influence on the level at the input terminal of the light emitting element 10_*n*+1. This will be described in detail below in conjunction with the timing diagram of FIG. 19.

In step S1801, inversion recovery is performed for the pixel driving circuit P(n+1, m). For example, in an inversion recovery phase P51, for the pixel driving circuit P(n+1, m), the first scanning signal terminal Vscan1_*n*+1 is at a high level, the second scanning signal terminal Vscan2_*n*+1 is at a high level, the first control signal terminal Vems_n+1 is at a low level, the second control signal terminal Vems_n+2 is at a low level, the first data signal terminal Vdata1 is at a low level Vd1-2, the second data signal terminal Vdata2 is at a low level, the first power signal terminal VDD_n+1 is at a power level, and the second power signal terminal VDD_n+2 is at the power level. Thereby, the first transistor T1 and the fourth transistor T4 of the pixel driving circuit P(n+1, m) are turned on, the third transistor T3, the second transistor T2, and the fifth transistor T5 of the pixel driving circuit P(n+1, m) are turned off, and a polarity of the light emitting element 10_*n*+1 is inverted under action of the levels at the first data signal terminal Vdata1 and the second data signal terminal Vdata2.

In step S1802, threshold voltage latch is performed for the pixel driving circuit P(n, m). For example, in a threshold voltage latching phase P52, for the pixel driving circuit P(n, m), the first scanning signal terminal Vscan1_*n* is at a low level, the second scanning signal terminal Vscan2_*n* is at a high level, the first control signal terminal Vems_n is at a high level, the second control signal terminal Vems_n+1 is at a high level, the first power signal terminal VDD_n is at a power level, and the second power signal terminals VDD_n+1 is at the power level. Thereby, the fourth transistor T4 of the pixel driving circuit P(n, m) and the third transistor T3 of the pixel driving circuit P(n+1, m) are turned on, the first transistor T1 and the third transistor T3 of the pixel driving circuit P(n, m) are turned off, the second transistor T2 and the fifth transistor T5 of the pixel driving circuit P(n, m) are turned off under action of levels at the first data signal terminal Vdata1 and the second data signal terminal Vdata2 respectively, and the second capacitor Cs2 of the pixel driving circuit P(n, m) is charged until the voltage at the node C of the pixel driving circuit P(n, m) is higher than that at the input terminal of the light emitting element 10_*n* by Vth2, wherein Vth2 represents a threshold voltage of the fifth transistor T5 of the pixel driving circuit P(n, m). This causes the threshold voltage Vth2 to be latched in the second capacitor Cs2 of the pixel driving circuit P(n, m).

In step S1803, data voltage input is performed for the pixel driving circuit P(n, m). For example, in a data voltage input phase P53, for the pixel driving circuit P(n, m), the first scanning signal terminal Vscan1_*n* is at a low level, the second scanning signal terminal Vscan2_*n* is at a high level, the first control signal terminal Vems_n is at a high level, the second control signal terminal Vems_n+1 is at a low level, the first data signal terminal Vdata1 is at a low level, the second data signal terminal Vdata2 is at a level Vd2-1, the first power signal terminal VDD_n is at a power level, and the second power signal terminal VDD_n+1 is at the power level. Thereby, the fourth transistor T4 of the pixel driving circuit P(n, m) is turned on, the third transistor T3 of the pixel driving circuit P(n+1, m) and the first transistor T1, the third transistor T3, the second transistor T2 and the fifth transistor T5 of the pixel driving circuit P(n, m) are turned off, the level Vd2-1 of the second data signal applied to the second data signal terminal Vdata2 is input to the node C of the pixel driving circuit P(n, m), and the level at the node C of the pixel driving circuit P(n, m) changes to Vd2-1 under action of the level Vd2-1 at the second data signal terminal Vdata2, so that the voltage at the input terminal of the light emitting element 10_*n* is adjusted to VB2.

In step S1804, light emission driving is performed for the pixel driving circuit P(n, m). For example, in a light emitting phase P54, for the pixel driving circuit P(n, m), the first scanning signal terminal Vscan1_*n* is at a low level, the second scanning signal terminal Vscan2_*n* is at a low level, the first control signal terminal Vems_n is at a high level, the second control signal terminal Vems_n+1 is at a high level, the first data signal terminal Vdata1 is at a low level, the second data signal terminal Vdata2 is at a low level, the first power signal terminal VDD_n is at a power level, and the second power signal terminal VDD_n+1 is at the power level. Thereby, the third transistor T3 of the pixel driving circuit P(n+1, m) is turned on, the fourth transistor T4, the first transistor T1, the third transistor T3, and the second transistor T2 of the pixel driving circuit P(n, m) are turned off, and thereby the voltage across the second capacitor Cs2 of the pixel driving circuit P(n, m) is maintained to be unchanged, so that the driving current provided by the fifth transistor T5 of the pixel driving circuit P(n, m) to the light emitting element 10_*n* is independent of the threshold voltage Vth2 of the fifth transistor T5 of the pixel driving circuit P(n, m). In the light emitting phase P54, for the pixel driving circuit in the $n^{th}$ row and the $m^{th}$ column, the second scanning signal terminal Vscan2_*n* may change from a high level to a low level before the second control signal terminal Vems_n+1 changes from a low level to a high level, thus avoiding a competitive risk phenomenon.

As described above, the inversion recovery phase is implemented in advance by one sub-frame in the frame in which driving is performed using the second pixel driving sub-circuit, which avoids the influence of the inversion recovery operation on the light emission of the light emitting element.

Figure 19:
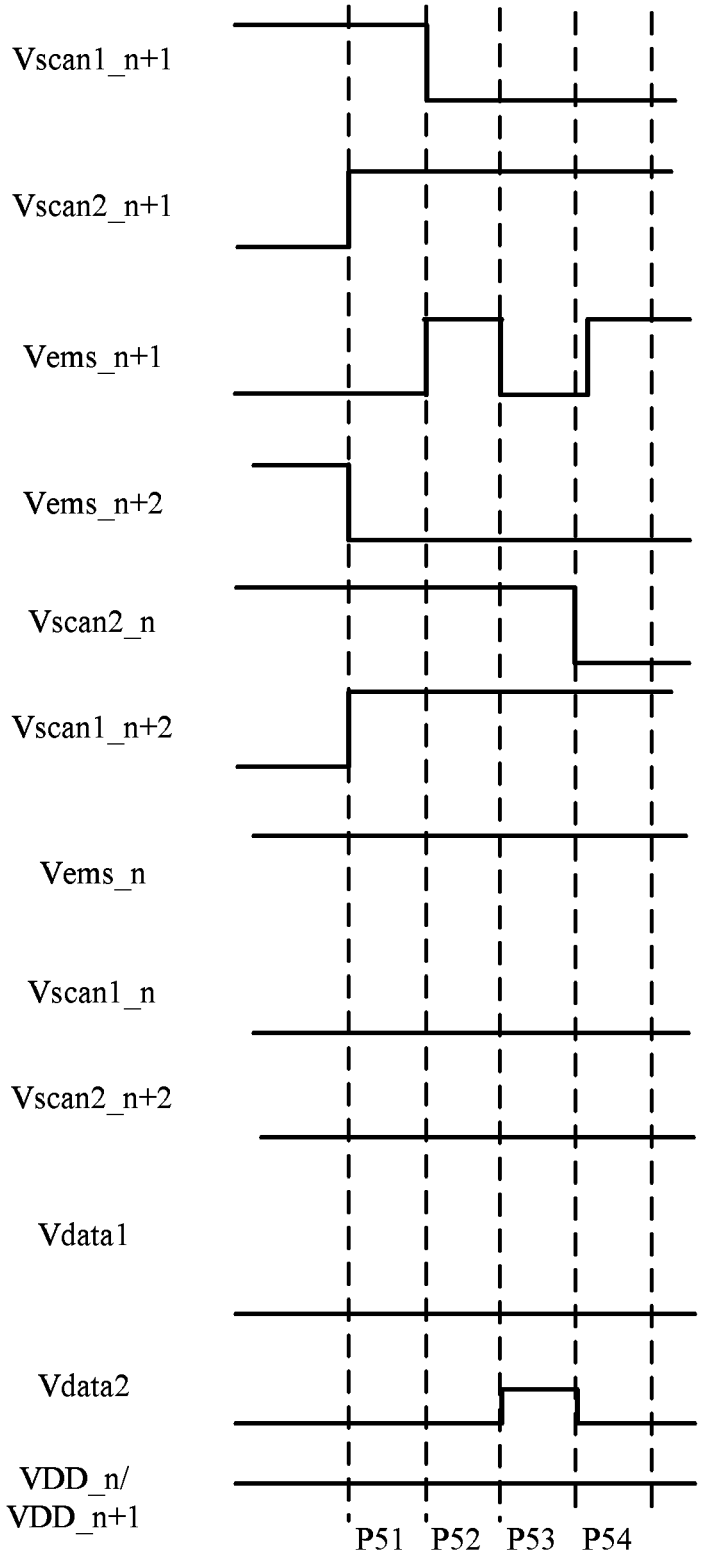
FIG. 19 illustrates a signal timing diagram of the operation of FIG. 18.

In the embodiment of FIGS. 18 and 19, in the reverse recovery phase, when the inversion recovery for the pixel P(n+1, m) is performed, the level at the driving signal output terminal B of the pixel driving circuit P(n+1, m) may decrease to less than −Vth1. However, at this time, the node C of the pixel driving circuit P(n+1, m) is at a low level (for example, zero volts), which results in that the gate-source voltage Vgs of the fifth transistor T5 of the pixel driving circuit P(n+1, m) is greater than Vth1, and if the gate-source voltage Vgs is greater than the threshold voltage Vth2 of the fifth transistor T5 of the pixel driving circuit P(n+1, m), the fifth transistor T5 is turned on. The pixel driving circuit P(n+2, m) is still driven by the first pixel driving sub-circuit, the third transistor T3 of the pixel driving circuit P(n+2, m) is turned on, the second power signal at the power signal terminal VDD_n+2 may be input into the driving signal output terminal B of the pixel driving circuit P(n+1, m) in a case where the fifth transistor T5 of the pixel driving circuit P(n+1, m) is turned on, and if Vth2 is less than Vth1, a balanced voltage at the driving signal output terminal B is greater than −Vth1, which may result in that the threshold voltage may not be latched. In order to suppress this phenomenon, the second transistor T2 of the pixel driving circuit P(n+2, m) may be turned off, thereby preventing the pixel driving circuit P(n+2, m) from influencing the inversion recovery of the pixel driving sub-circuit P(n+1, m). For example, as shown in FIG. 19, in the inversion recovery phase, for the pixel driving circuit P(n+2, m), the first scanning signal terminal Vscan1_*n*+2 may be at a high level, and the second scanning signal terminal Vscan2_*n*+2 may be at a low level, so that the first transistor T1 of the pixel driving circuit P(n+2, m) is turned on, and the fourth transistor T4 of the pixel driving circuit P(n+2, m) is turned off, and as described above, in this phase, Vems_n+2 is at a low level, so that the third transistor T3 of the pixel driving circuit P(n+2, m) is turned off, and the first data signal terminal Vdata1 is at a low level, so that the second transistor T2 of the pixel driving circuit P(n+2, m) is turned off.

Figure 20:
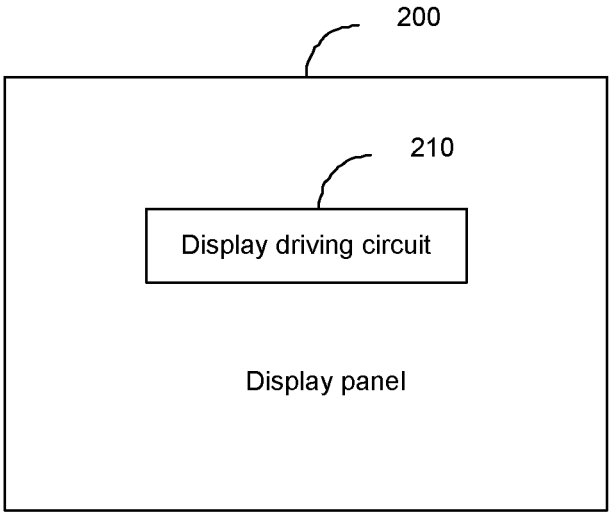
FIG. 20 illustrates a schematic block diagram of a display panel according to an embodiment of the present disclosure.

The present disclosure further provides a display panel. FIG. 20 illustrates a schematic block diagram of a display panel according to an embodiment of the present disclosure. As shown in FIG. 20, the display panel 200 comprises a display driving circuit 210 which may be implemented by the display driving circuit according to any of the embodiments described above. Types of the display panel according to embodiments of the present disclosure comprise, but not limited to, an OLED display panel, an AMOLED display panel, etc.

Although the present disclosure has been described with reference to a few exemplary embodiments, it should be understood that terms used are illustrative and exemplary and not restrictive. The present disclosure may be embodied in a variety of forms without departing from the spirit or essence of the present disclosure. Therefore, it should be understood that the embodiments described above are not limited to any details described above, but should be construed broadly within the spirit and scope defined by the appended claims. Therefore, all changes and variations which fall within the scope of the claims or the equivalents thereof are intended to be covered by the appended claims.

We claim:

1. A pixel driving circuit, comprising: a first pixel driving sub-circuit and a second pixel driving sub-circuit, wherein the first pixel driving sub-circuit is connected to a first scanning signal terminal, a first control signal terminal, a first data signal terminal and a driving signal output terminal, and the first pixel driving sub-circuit is configured to provide a driving signal to the driving signal output terminal in a first period and perform threshold voltage compensation on the second pixel driving sub-circuit in a second period under control of signals at the first scanning signal terminal, the first control signal terminal, and the first data signal terminal; and the second pixel driving sub-circuit is connected to a second scanning signal terminal, a second control signal terminal, a second data signal terminal and the driving signal output terminal, and the second pixel driving sub-circuit is configured to provide a driving signal to the driving signal output terminal in the second period and perform threshold voltage compensation on the first pixel driving sub-circuit in the first period under control of signals at the second scanning signal terminal, the second control signal terminal, and the second data signal terminal.

2. The pixel driving circuit according to claim 1, wherein the first pixel driving sub-circuit comprises:

a first control sub-circuit connected to a first control signal terminal, a first power signal terminal, and a first control node, the first control sub-circuit is configured to output a signal at the first power signal terminal to the first control node under control of a signal at the first control signal terminal; and a first driving sub-circuit connected to the first control node, the first data signal terminal, the first scanning signal terminal, and the driving signal output terminal, the first driving sub-circuit is configured to provide the driving signal to the driving signal output terminal in the first period and perform threshold voltage compensation on the second pixel driving sub-circuit in the second period under control of signals at the first data signal terminal, the first scanning signal terminal, and the first control node.

3. The pixel driving circuit according to claim 2, wherein the first driving sub-circuit comprises a first transistor, a second transistor and a first capacitor, wherein the first transistor has a gate connected to the first scanning signal terminal, a first electrode connected to the first data signal terminal, and a second electrode connected to a gate of the second transistor;

the second transistor has the gate connected to the second electrode of the first transistor, a first electrode connected to the first control node, and a second electrode connected to the driving signal output terminal; and the first capacitor has one terminal connected to the gate of the second transistor, and the other terminal connected to the driving signal output terminal; and the first control sub-circuit comprises a third transistor, wherein the third transistor has a gate connected to the first control signal terminal, a first electrode connected to the first power signal terminal, and a second electrode connected to the first control node.

4. The pixel driving circuit according to claim 1, wherein the second pixel driving sub-circuit comprises:

a second control sub-circuit connected to a second control signal terminal, a second power signal terminal, and a second control node, the second control sub-circuit is configured to output a signal at the second power signal terminal to the second control node under control of a signal at the second control signal terminal; and a second driving sub-circuit connected to the second control node, the second data signal terminal, the second scanning signal terminal, and the driving signal output terminal, the second driving sub-circuit is configured to provide the driving signal to the driving signal output terminal in the second period and perform threshold voltage compensation on the first pixel driving sub-circuit in the first period under control of signals at the second data signal terminal, the second scanning signal terminal, and the second control node.

5. The pixel driving circuit according to claim 4, wherein the second driving sub-circuit comprises a fourth transistor, a fifth transistor and a second capacitor, wherein the fourth transistor has a gate connected to the second scanning signal terminal, a first electrode connected to the second data signal terminal, and a second electrode connected to a gate of the fifth transistor;

the fifth transistor has the gate connected to the second electrode of the fourth transistor, a first electrode connected to the second control node, and a second electrode connected to the driving signal output terminal; and the second capacitor has one terminal connected to the gate of the fifth transistor, and the other terminal connected to the driving signal output terminal; and the second control sub-circuit comprises a sixth transistor, wherein the sixth transistor has a gate connected to the second control signal terminal, a first electrode connected to the second power signal terminal, and a second electrode connected to the second control node.

6. A display driving circuit, comprising a plurality of pixel driving circuits according to claim 1, which are arranged in an N×M array, where N and M are positive integers.

7. The display driving circuit according to claim 6, wherein a second control sub-circuit of a pixel driving circuit in an $n^{th}$ row and an $m^{th}$ column is multiplexed as a first control sub-circuit of a pixel driving circuit in an $(n+1)^{th}$ row and the $m^{th}$ column, a second control signal terminal of the pixel driving circuit in the $n^{th}$ row and the $m^{th}$ column is multiplexed as a first control signal terminal of the pixel driving circuit in the $(n+1)^{th}$ row and the $m^{th}$ column, a second power signal terminal of the pixel driving circuit in the $n^{th}$ row and the $m^{th}$ column is multiplexed as a first power signal terminal of the pixel driving circuit in the $(n+1)^{th}$ row and the $m^{th}$ column, and a second control node of the pixel driving circuit in the $n^{th}$ row and the $m^{th}$ column is multiplexed as a first control node of the pixel driving circuit in the $(n+1)^{h}$ row and the $m^{th}$ column, where n is a positive integer greater than or equal to 1 and less than or equal to N−1, and m is a positive integer greater than or equal to 1 and less than or equal to M.

8. A display panel, comprising the display driving circuit according to claim 6.

9. A method for controlling the display driving circuit according to claim 6, comprising: for each of the plurality of pixel driving circuits in the display driving circuit, controlling, in a first period, a first pixel driving sub-circuit to generate a driving signal, and controlling a second pixel driving sub-circuit to perform threshold voltage compensation on the first pixel driving sub-circuit; and controlling, in a second period, the second pixel driving sub-circuit to generate a driving signal, and controlling the first pixel driving sub-circuit to perform threshold voltage compensation on the second pixel driving sub-circuit.

10. The method according to claim 9, wherein the first driving sub-circuit in the first pixel driving sub-circuit comprises a first transistor, a second transistor and a first capacitor, and for a pixel driving circuit in an $n^{th}$ row and an $m^{th}$ column, controlling, in a first period, a first pixel driving sub-circuit to generate a driving signal, and controlling a second pixel driving sub-circuit to perform threshold voltage compensation on the first pixel driving sub-circuit comprises:

applying, in an inversion recovery phase, a first level to a first scanning signal terminal of the pixel driving circuit in the $n^{th}$ row and the $n^{th}$ column, applying the first level to a second control signal terminal of the pixel driving circuit in the $n^{th}$ row and the $m^{th}$ column, and applying a reference level to a second power signal terminal of the pixel driving circuit in the $n^{th}$ row and the $m^{th}$ column, so that a level at a driving signal output terminal of the pixel driving circuit in the $n^{th}$ row and the $m^{th}$ column is inverted;

applying, in a threshold voltage latching phase, the first level to a first control signal terminal of the pixel driving circuit in the $n^{th}$ row and the $m^{th}$ column, applying a second level to the second control signal terminal of the pixel driving circuit in the $n^{th}$ row and the $m^{th}$ column, and applying a power level to a second power signal terminal of the pixel driving circuit in the $n^{th}$ row and the $m^{th}$ column, so that a threshold voltage of a second transistor is latched in a first capacitor in the pixel driving circuit in the $n^{th}$ row and the $m^{th}$ column;

applying, in a data voltage input phase, the second level to the first control signal terminal of the pixel driving circuit in the $n^{th}$ row and the $m^{th}$ column, and applying a first data signal to a first data signal terminal of the pixel driving circuit in the $n^{th}$ row and the $m^{th}$ column, so that the first data signal at the first data signal terminal is input into a gate of the second transistor in the pixel driving circuit in the $n^{th}$ row and the $m^{th}$ column; and causing, in a light emitting phase, the first scanning signal terminal of the pixel driving circuit in the $n^{th}$ row and the $m^{th}$ column to change from the first level to the second level, and causing the first control signal terminal of the pixel driving circuit in the $n^{th}$ row and the $m^{th}$ column to change from the second level to the first level, so that a driving signal is provided to the driving signal output terminal of the pixel driving circuit in the $n^{th}$ row and the $m^{th}$ column.

11. The method according to claim 9, wherein the first pixel driving sub-circuit comprises a first control sub-circuit and a first driving sub-circuit, the second pixel driving sub-circuit comprises a second control sub-circuit and a second driving sub-circuit, wherein the second driving sub-circuit comprises a fourth transistor, a fifth transistor, and a second capacitor, and a second control sub-circuit of a pixel driving circuit in an $n^{th}$ row and an $m^{th}$ column is multiplexed as a first control sub-circuit of a pixel driving circuit in an $(n+1)^{th}$ row and the $m^{th}$ column, and for the pixel driving circuit in the $n^{th}$ row and the $m^{th}$ column, controlling, in a second period, the second pixel driving sub-circuit to generate a driving signal, and controlling the first pixel driving sub-circuit to perform threshold voltage compensation on the second pixel driving sub-circuit comprises:

applying, in an inversion recovery phase, a first level to a first scanning signal terminal of the pixel driving circuit in the $(n+1)^{th}$ row and the $m^{th}$ column, and applying the first level to a second scanning signal terminal of the pixel driving circuit in the $(n+1)^{th}$ row and the $m^{th}$ column, so that a level at a driving signal output terminal of the pixel driving circuit in the $(n+1)^{th}$ row and the $m^{th}$ column is inverted;

applying, in a threshold voltage latching phase, the first level to a second scanning signal terminal of the pixel driving circuit in the $n^{th}$ row and the $m^{th}$ column, applying the first level to a first control signal terminal of the pixel driving circuit in the $n^{th}$ row and the $m^{th}$ column, and applying the first level to a second control signal terminal of the pixel driving circuit in the $n^{th}$ row and the $m^{th}$ column, so that a threshold voltage of a fifth transistor is latched in a second capacitor in the pixel driving circuit in the $n^{th}$ row and the $m^{th}$ column;

applying, in a data voltage input phase, the second level to the second control signal terminal of the pixel driving circuit in the $n^{th}$ row and the $m^{th}$ column, and applying a second data signal to a second data signal terminal of the pixel driving circuit in the $n^{th}$ row and the $m^{th}$ column, so that the second data signal at the second data signal terminal is input into a gate of the fifth transistor in the pixel driving circuit in the $n^{th}$ row and the $m^{th}$ column; and causing, in a light emitting phase, the second scanning signal terminal of the pixel driving circuit in the $n^{th}$ row and the $m^{th}$ column to change from the first level to the second level, and causing the second control signal terminal of the pixel driving circuit in the $n^{th}$ row and the $m^{th}$ column to change from the second level to the first level, so that a driving signal is provided to the driving signal output terminal of the pixel driving circuit in the $n^{th}$ row and the $m^{th}$ column.

12. The method according to claim 11, wherein in the light emitting phase, the second scanning sign terminal of the pixel driving circuit in the $n^{th}$ row and the $m^{th}$ column is caused to change from the first level to the second level before causing the second control signal terminal of the pixel driving circuit in the $n^{th}$ row and the $m^{th}$ column to change from the second level to the first level.

13. The method according to claim 11, further comprising: applying, in the inversion recovery phase, the first level to a first scanning signal terminal of a pixel driving circuit in an $(n+2)^{th}$ row and the $m^{th}$ column, and applying the second level to a second scanning signal terminal of the pixel driving circuit in an $(n+2)^{th}$ row and the $m^{th}$ column.

14. A method for controlling the pixel driving circuit according to claim 1, comprising:

controlling, in a first period, the first pixel driving sub-circuit to generate a driving signal, and controlling the second pixel driving sub-circuit to perform threshold voltage compensation on the first pixel driving sub-circuit; and controlling, in a second period, the second pixel driving sub-circuit to generate a driving signal, and controlling the first pixel driving sub-circuit to perform threshold voltage compensation on the second pixel driving sub-circuit.

15. The method according to claim 14, wherein a first driving sub-circuit in the first pixel driving sub-circuit comprises a first transistor, a second transistor, and a first capacitor, and controlling, in a first period, the first pixel driving sub-circuit to generate a driving signal, and controlling the second pixel driving sub-circuit to perform threshold voltage compensation on the first pixel driving sub-circuit comprises:

applying, in an inversion recovery phase, a first level to the first scanning signal terminal, applying the first level to the second control signal terminal, and applying a reference level to the second power signal terminal, so that a level at the driving signal output terminal is inverted b the second pixel driving sub-circuit;

applying, in a threshold voltage latching phase, the first level to the first control signal terminal, applying a second level to the second control signal terminal, and applying a power level to the second power signal terminal, so that a threshold voltage of a second transistor is latched in a first capacitor;

causing, in a data voltage input phase, applying the second level to the first control signal terminal, and applying a first data signal to the first data signal terminal, so that the first data signal at the first data signal terminal is input into a gate of the second transistor; and causing, in a light emitting phase, the first scanning signal terminal to change from the first level to the second level, and causing the first control signal terminal to change from the second level to the first level, so that a driving signal is provided to the driving signal output terminal.

16. The method according to claim 15, wherein controlling, in a first period, the first pixel driving sub-circuit to generate a driving signal, and controlling the second pixel driving sub-circuit to perform threshold voltage compensation on the first pixel driving sub-circuit further comprises:

applying, in a voltage adjustment phase between the inversion recovery phase and the threshold voltage latching phase, the first level to the second scanning signal terminal, causing the second control signal terminal to change from the first level to the second level, and causing the second power signal terminal to change from the reference level to the power level.

17. The method according to claim 15, wherein in the light emitting phase, the first scanning signal terminal is caused to change from the first level to the second level before causing the first control signal terminal to change from the second level to the first level.

18. The method according to claim 14, wherein a second driving sub-circuit in the second pixel driving sub-circuit comprises a fourth transistor, a fifth transistor and a second capacitor, and controlling, in a second period, the second pixel driving sub-circuit to generate a driving signal, and controlling the first pixel driving sub-circuit to perform threshold voltage compensation on the second pixel driving sub-circuit comprises:

applying, in an inversion recovery phase, a first level to the second scanning signal terminal, applying the first level to the first control signal terminal, and applying a reference level to the first power signal terminal, so that a level at the driving signal output terminal is inverted by the first pixel driving sub-circuit;

applying, in a threshold voltage latching phase, the first level to the second control signal terminal, applying a second level to the first control signal terminal, and applying a power level to the first power signal terminal, so that a threshold voltage of a fifth transistor is latched in a second capacitor;

applying, in a data voltage input phase, the second level to the second control signal terminal, and applying a second data signal to the second data signal terminal, so that the second data signal at the second data signal terminal is input into a gate of the fifth transistor; and causing, in a light emitting phase, the second scanning signal terminal to change from the first level to the second level, and causing the second control signal terminal to change from the second level to the first level, so that a driving signal is provided to the driving signal output terminal.

19. The method according to claim 18, wherein in the light emitting phase, the second scanning signal terminal is caused to change from the first level to the second level before causing the second control signal terminal to change from the second level to the first level.

20. The method according to claim 14, wherein the first period is an odd frame, and the second period is an even frame; or the first period is an even frame, and the second period is an odd frame.

* * * * *